US011189413B2

(12) United States Patent
Oshima et al.

(10) Patent No.: US 11,189,413 B2
(45) Date of Patent: Nov. 30, 2021

(54) MULTILAYER COIL COMPONENT AND METHOD FOR PRODUCING THE SAME

(71) Applicant: TDK CORPORATION, Tokyo (JP)

(72) Inventors: Yuya Oshima, Tokyo (JP); Shinichi Kondo, Tokyo (JP); Junichi Otsuka, Tokyo (JP); Yohei Tadaki, Tokyo (JP); Kazuo Iwai, Tokyo (JP); Masayuki Suzuki, Yurihonjo (JP); Shigeshi Osawa, Yurihonjo (JP); Kazuhiro Ebina, Tokyo (JP); Makoto Yoshino, Tokyo (JP); Mamoru Kawauchi, Tokyo (JP)

(73) Assignee: TDK CORPORATION, Tokyo (JP)

( * ) Notice: Subject to any disclaimer, the term of this patent is extended or adjusted under 35 U.S.C. 154(b) by 237 days.

(21) Appl. No.: 16/158,779

(22) Filed: Oct. 12, 2018

(65) Prior Publication Data

US 2019/0122800 A1 Apr. 25, 2019

(30) Foreign Application Priority Data

Oct. 20, 2017 (JP) ..... JP2017-203316

(51) Int. Cl.

| | |
|---|---|
| ***H01F 17/00*** | (2006.01) |
| ***H01F 27/29*** | (2006.01) |
| ***H01F 27/245*** | (2006.01) |
| ***H01F 5/00*** | (2006.01) |

(Continued)

(52) U.S. Cl.

CPC ..... *H01F 17/0013* (2013.01); *H01F 5/003* (2013.01); *H01F 27/245* (2013.01); *H01F 27/2804* (2013.01); *H01F 27/292* (2013.01); *H01F 41/046* (2013.01); *H01F 2017/0073* (2013.01); *H01F 2027/2809* (2013.01)

(58) Field of Classification Search

CPC .... H01F 5/003; H01F 17/0013; H01F 27/245; H01F 27/2804; H01F 27/292; H01F 2017/0073; H01F 2027/2809

USPC ..... 336/200, 232

See application file for complete search history.

(56) References Cited

U.S. PATENT DOCUMENTS

2008/0246579 A1 10/2008 Mizuno et al.
2008/0250628 A1* 10/2008 Maeda ..... H01F 17/0013 29/602.1

FOREIGN PATENT DOCUMENTS

| | | | |
|---|---|---|---|
| CN | 101572161 | A | 11/2009 |
| CN | 102084441 | A | 6/2011 |
| JP | H06-060114 | U | 8/1994 |

(Continued)

*Primary Examiner* — Tszfung J Chan
(74) *Attorney, Agent, or Firm* — Oliff PLC

(57) ABSTRACT

First internal conductors are separated from each other in a first direction. Each of the first internal conductors includes a coil portion and a pad portion having a width larger than a width of the coil portion. The pad portions adjacent to each other in the first direction are connected to each other via a through-hole conductor and overlap each other when viewed from the first direction. When viewed from the first direction, each of the coil portions includes a first portion not overlapping the pad portion adjacent in the first direction and a second portion overlapping a part of the pad portion adjacent in the first direction. A second internal conductor is disposed on the same layer as the second portion and is positioned to overlap a portion of the pad portion adjacent in the first direction not overlapping the second portion when viewed from the first direction.

8 Claims, 11 Drawing Sheets

(51) Int. Cl.
*H01F 41/04* (2006.01)
*H01F 27/28* (2006.01)

(56) References Cited

FOREIGN PATENT DOCUMENTS

| | | | | | |
|---|---|---|---|---|---|
| JP | 2001-176725 | A | | 6/2001 | |
| JP | 2004-296992 | A | | 10/2004 | |
| WO | 2007/072612 | A1 | | 6/2007 | |
| WO | WO-2010010799 | A1 | * | 1/2010 | ..... H01F 17/0013 |

* cited by examiner

MULTILAYER COIL COMPONENT AND METHOD FOR PRODUCING THE SAME

BACKGROUND OF THE INVENTION

1. Field of the Invention

The present invention relates to a multilayer coil component and a method for producing the same.

2. Description of Related Art

Known multilayer coil components include an element body and a plurality of internal conductors separated from each other in a first direction in the element body (for example, refer to Japanese Unexamined Patent Publication No. 2001-176725). The plurality of internal conductors is electrically connected to each other via a through-hole conductor to configure a coil. Each of the internal conductors includes a coil portion and a pad portion that has a width larger than a width of the coil portion when viewed from the first direction. The pad portions adjacent to each other in the first direction are connected to each other via the through-hole conductor and overlap each other when viewed from the first direction. When viewed from the first direction, the coil portion overlaps the pad portion adjacent to the coil portion in the first direction.

SUMMARY OF THE INVENTION

In general, a process for producing a multilayer coil component includes providing conductor patterns for internal conductors on a plurality of green sheets. The plurality of green sheets with the conductor patterns is laminated. In the laminating step, laminate deviation may occur. The laminate deviation is a phenomenon that the conductor patterns adjacent to each other in the lamination direction deviate from each other in a direction orthogonal to the lamination direction.

In the manufacture of the multilayer coil component described in Japanese Unexamined Patent Publication No. 2001-176725, in the laminating step, a pad conductor pattern to be a wider pad portion is adjacent to a coil conductor pattern to be a narrow coil portion in the lamination direction. Therefore, laminate deviation between the coil conductor pattern and the pad conductor pattern adjacent to each other in the lamination direction may increase. Consequently, in the multilayer coil component, laminate deviation between the internal conductors tends to occur. The laminate deviation between the internal conductors is a phenomenon that the internal conductors adjacent to each other in the first direction deviate from each other in a direction orthogonal to the first direction. For example, in a case in which the conductor pattern is laminated with an outward deviation in the laminating step, the distance between the cut position and the conductor patterns decreases by the outward deviation of the conductor pattern, when the laminated body of the green sheets is cut into chips of a predetermined size after the laminating step. For example, in a case in which the conductor pattern is laminated with an inward deviation in the laminating step, the internal conductor deviates inward. Therefore, an inner diameter of the coil decreases by the inward deviation of the internal conductor, and the multilayer coil component may not have a desired L value. A large laminate deviation may cause a connection failure between the pad portions adjacent to each other in the first direction.

An object of a first aspect of the present invention is to provide a multilayer coil component with laminate deviation suppressed. An object of a second aspect of the present invention is to provide a method for producing the multilayer coil component with laminate deviation suppressed.

The multilayer coil component according to the first aspect includes an element body, a plurality of first internal conductors that is separated from each other in a first direction in the element body, and at least one second internal conductor that is disposed on the same layer as at least one of the plurality of first internal conductors. The plurality of first internal conductors configures a coil by electrically connecting the plurality of first internal conductors to each other via a through-hole conductor. Each of the first internal conductors includes a coil portion and a pad portion that has a width larger than a width of the coil portion when viewed from the first direction. The pad portions adjacent to each other in the first direction are connected to each other via the through-hole conductor and overlap each other when viewed from the first direction. When viewed from the first direction, each of the coil portions includes a first portion that does not overlap the pad portion adjacent in the first direction and a second portion that overlaps a part of the pad portion adjacent in the first direction. The second internal conductor is disposed on the same layer as the second portion and is positioned to overlap a portion of the pad portion adjacent in the first direction that does not overlap the second portion when viewed from the first direction.

In the first aspect, when viewed from the first direction, each of the pad portions includes a portion overlapping the second portion of the coil portion and a portion not overlapping the second portion of the coil portion. When viewed from the first direction, the second internal conductor disposed on the same layer as the second portion is positioned to overlap the portion of the pad portion not overlapping the second portion. When viewed from the first direction, the second portions of the first internal conductors and the second internal conductor overlap the pad portions adjacent in the first direction. Therefore, in the first aspect, an area of a region where the inner conductors adjacent to each other in the first direction overlap each other is large, as compared with in a configuration in which only the first internal conductor overlaps the pad portion. Consequently, the internal conductors adjacent to each other in the first direction tend not to deviate from each other in a direction orthogonal to the first direction. In the first aspect, laminate deviation is suppressed.

In the first aspect, the second internal conductor may be formed integrally with the second portion of the first internal conductor. When viewed from the first direction, the second portion and the second internal conductor may constitute a third portion that overlaps the pad portion adjacent in the first direction. A width of the third portion may be larger than a width of the first portion. In this configuration, since the width of the third portion is larger than the width of the first portion, the area of the region where the inner conductors adjacent to each other in the first direction overlap each other is large. Therefore, in this configuration, the laminate deviation is reliably suppressed.

In the first aspect, the second internal conductor may be separated from the second portion of the first internal conductor. In this configuration, in addition to the second portion of the first internal conductor, the second internal conductor separated from the second portion overlaps the pad portion adjacent in the first direction. Therefore, in this configuration, the area of the region where the inner conductors adjacent to each other in the first direction overlap each other is large, as compared with in a configuration where only the second portion overlaps the pad portion. Consequently, in this configuration, the laminate deviation is reliably suppressed.

In the first aspect, when viewed from the first direction, a width of a portion of the coil portion overlapping the pad portion adjacent in the first direction may be smaller than a width of the pad portion adjacent in the first direction. In a case in which the width of the portion of the coil portion overlapping the pad portion adjacent in the first direction is smaller than the width of the pad portion adjacent in the first direction, an area of a region inside the coil portion through which magnetic flux passes is not too small. Therefore, this configuration ensures the desired L value.

In the first aspect, when viewed from the first direction, the second internal conductor may be positioned inside the second portion of the first internal conductor. The entire second internal conductor may overlap the portion of the pad portion adjacent in the first direction not overlapping the second portion. In a case in which the entire second internal conductor overlaps the portion of the pad portion adjacent in the first direction not overlapping the second portion, an area of a region inside the coil portion through which magnetic flux passes is not too small. Therefore, this configuration ensures the desired L value.

According to a second aspect, a method for producing the multilayer coil component according to the first aspect includes providing a conductor pattern on a plurality of green sheets. The plurality of green sheets is laminated. The conductor pattern includes a first internal conductor pattern to be the first internal conductor and a second internal conductor pattern to be the second internal conductor. The first internal conductor pattern includes a coil conductor pattern to be the coil portion and a pad conductor pattern to be the pad portion. The coil conductor pattern includes a first portion conductor pattern to be the first portion and a second portion conductor pattern to be the second portion. In the providing step, the second internal conductor pattern is formed on the same layer as the second portion conductor pattern. In the laminating step, the green sheets are laminated such that, when viewed from a lamination direction, the second portion conductor pattern overlaps a part of the pad conductor pattern and the second internal conductor pattern overlaps a portion of the pad conductor pattern not overlapping the second portion conductor pattern.

In the second aspect, an area of a region where the conductor patterns adjacent to each other in the lamination direction overlap each other is large, as compared with in a case in which the green sheets are laminated such that only the second portion conductor pattern overlaps the pad conductor pattern. Therefore, the conductor patterns adjacent to each other in the lamination direction tend not to deviate from each other in a direction orthogonal to the lamination direction. The second aspect suppresses laminate deviation between the conductor patterns adjacent to each other in the lamination direction. Consequently, in the obtained multilayer coil component, laminate deviation between the internal conductors adjacent to each other in the first direction is suppressed.

In the second aspect, after the providing step and before the laminating step, a ratio of a thickness of the conductor pattern to a thickness of the green sheet may be 1.1 to 2.0 inclusive. In a case in which the thickness of the conductor pattern is too large relative to the green sheet, the laminate deviation may increase. In a case in which the ratio of the thickness of the conductor pattern to the thickness of the green sheet is 1.1 to 2.0 inclusive, the thickness of the conductor pattern is not too large relative to the thickness of the green sheet, thereby suppressing an increase in the laminate deviation.

In the second aspect, after the providing step and before the laminating step, a ratio of a width of the first portion conductor pattern to a width of the pad conductor pattern may be 0.35 to 0.6 inclusive.

In a case in which the ratio of the width of the first portion conductor pattern to the width of the pad conductor pattern is equal to or less than 0.6, the width of the first portion conductor pattern is as small as possible relative to the width of the pad conductor pattern, and thus an area of a region inside the coil portion through which magnetic flux passes is not too small. In this case, the desired L value is ensured. Even in a case in which the width of the first portion conductor pattern is as small as possible relative to the width of the pad conductor pattern, the area of the region where the conductor patterns adjacent to each other in the lamination direction overlap each other is large as described above, and thus the laminate deviation between the conductor patterns adjacent to each other in the lamination direction is suppressed. Consequently, the desired L value is reliably obtained and the laminate deviation is suppressed.

In a case in which the ratio of the width of the first portion conductor pattern to the width of the pad conductor pattern is smaller than 0.35, the width of the first portion conductor pattern is small and the ratio of the width of the pad conductor pattern to the width of the first portion conductor pattern is too large. Therefore, an area of a region of the pad portion not overlapping the coil portion adjacent in the first direction is too large. In this case, the pad portion may inhibit magnetic flux to decrease impedance. In a case in which the ratio of the width of the first portion conductor pattern to the width of the pad conductor pattern is equal to or more than 0.35, the ratio of the width of the pad conductor pattern to the width of the first portion conductor pattern is not too large. Therefore, the area of the region of the pad portion not overlapping the coil portion adjacent in the first direction is not too large, thereby suppressing decrease in the impedance.

The present invention will become more fully understood from the detailed description given hereinafter and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF EMBODIMENTS

Figure 1:
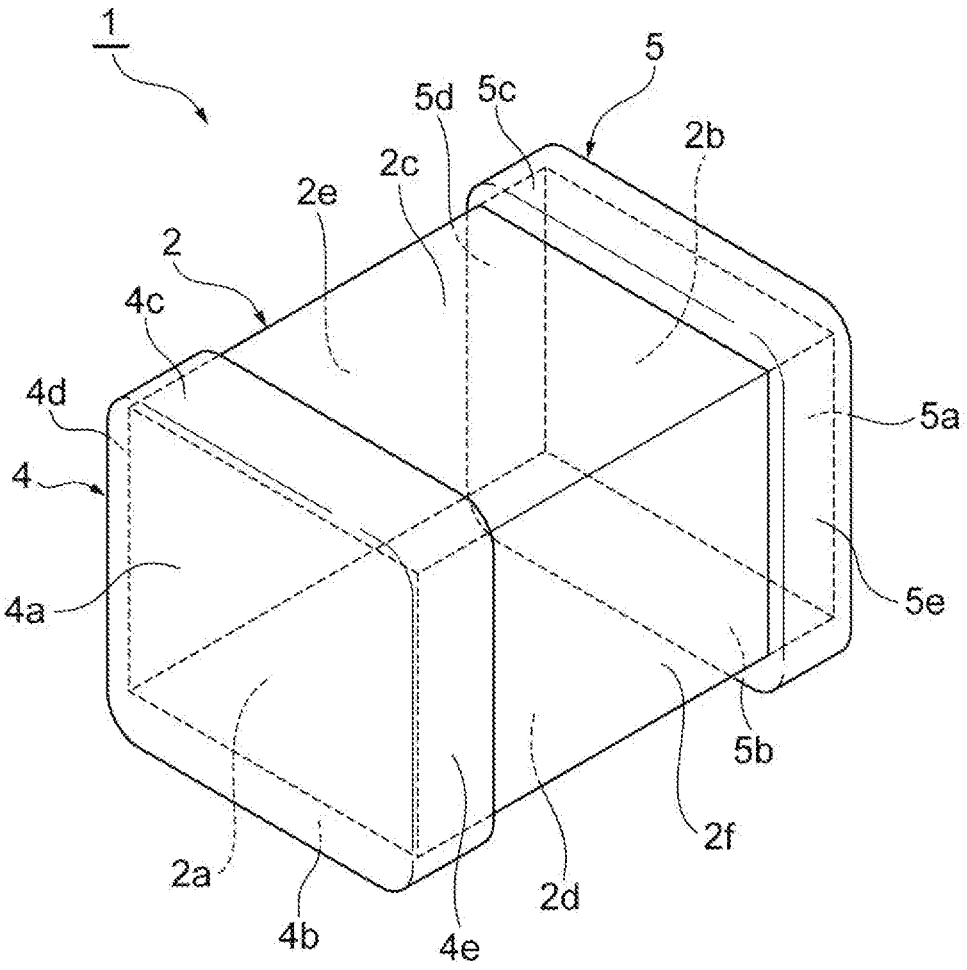
FIG. 1 is a perspective view of a multilayer coil component according to a first embodiment.

Hereinafter, embodiments of the present invention will be described in detail with reference to the accompanying drawings. In the following description, the same elements or elements having the same functions are denoted with the same reference numerals and overlapped explanation is omitted.

First Embodiment

Figure 2:
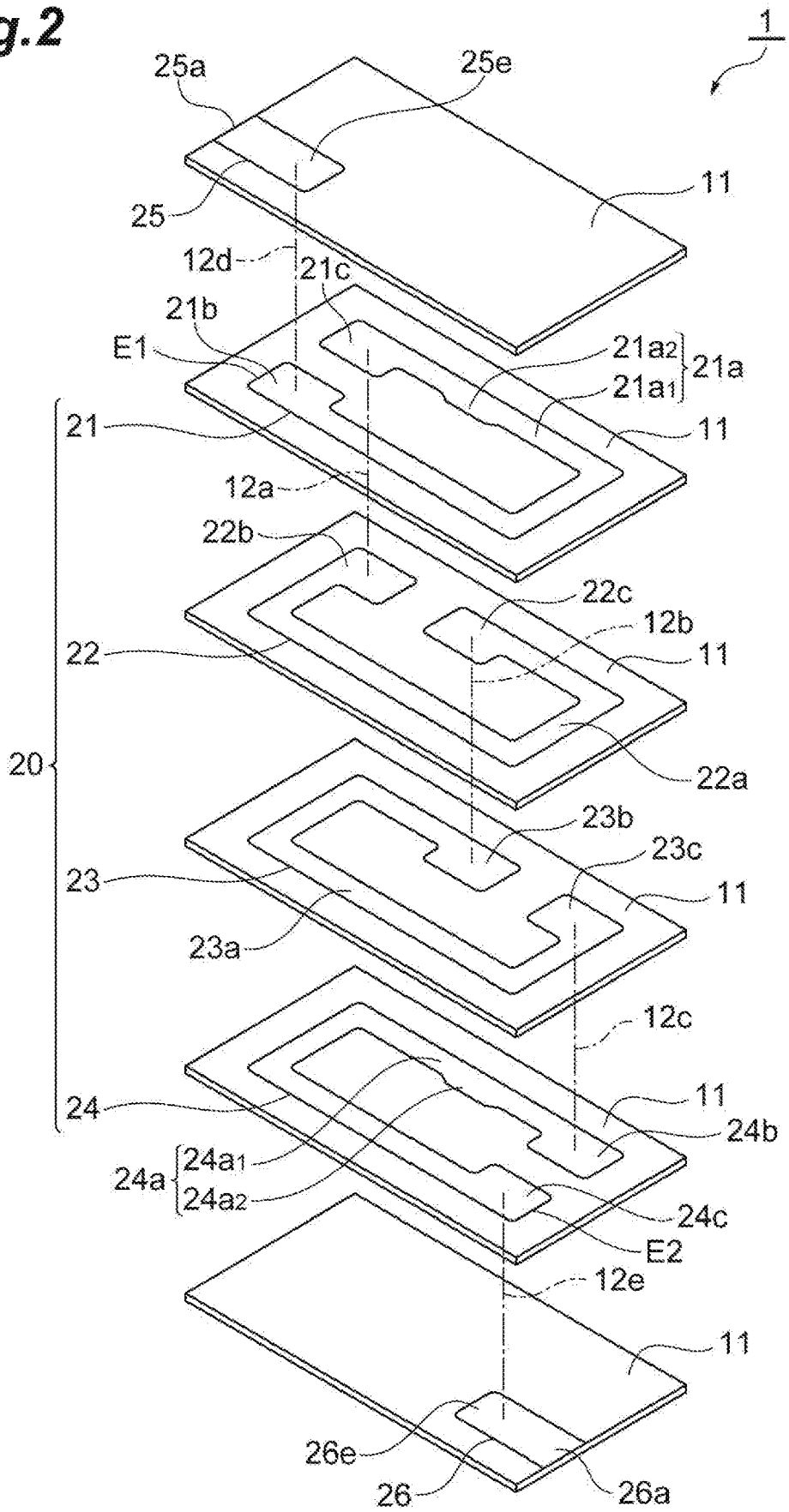
FIG. 2 is an exploded perspective view of the multilayer coil component according to the first embodiment.

A configuration of a multilayer coil component according to a first embodiment will be described with reference to FIGS. 1 and 2. FIG. 1 is a perspective view of a multilayer coil component according to the first embodiment. FIG. 2 is an exploded perspective view of the multilayer coil component illustrated in FIG. 1.

As illustrated in FIG. 1, a multilayer coil component 1 includes a element body 2 and a pair of external electrodes 4 and 5 disposed on both ends of the element body 2.

The element body 2 has a rectangular parallelepiped shape. The element body 2 includes a pair of end surfaces 2*a* and 2*b* opposing each other and four side surfaces 2*c*, 2*d*, 2*e*, and 2*f*. The side surfaces 2*c*, 2*d*, 2*e*, and 2*f* extend in a direction in which the pair of end surfaces 2*a* and 2*b* opposes each other to couple the pair of end surfaces 2*a* and 2*b*. For example, in a case in which the multilayer coil component 1 is mounted on an electronic device not illustrated, the side surface 2*d* opposes the electronic device. The electronic device includes a circuit board or an electronic component, for example. The side surface 2*d* is a mounting surface opposing the electronic device. The side surface 2*d* is arranged to constitute the mounting surface.

The direction in which the pair of end surfaces 2*a* and 2*b* opposes each other, the direction in which the pair of side surfaces 2*c* and 2*d* opposes each other, and the direction in which the pair of side surfaces 2*e* and 2*f* opposes each other, are approximately orthogonal to one another. The rectangular parallelepiped shape includes a rectangular parallelepiped shape in which corners and ridges are chamfered, and a rectangular parallelepiped shape in which the corners and ridges are rounded.

As illustrated in FIG. 2, the element body 2 is configured by laminating a plurality of insulation layers 11. The element body 2 includes the plurality of laminated insulation layers 11. The insulation layers 11 are laminated in the direction in which the pair of side surfaces 2*c* and 2*d* opposes each other. The lamination direction of the insulation layers 11 coincides with the direction in which the pair of side surfaces 2*c* and 2*d* opposes each other. Hereinafter, the direction in which the pair of side surfaces 2*c* and 2*d* opposes each other will also be called "lamination direction". Each of the insulation layers 11 has an approximately rectangular shape when viewed from the lamination direction. The multilayer coil component 1 includes a plurality of coil conductors 21 to 24 and a plurality of lead conductors 25 and 26. The coil conductors 21 to 24 constitute internal conductors, for example.

Each of the insulation layers 11 includes a sintered body of a ceramic green sheet containing a magnetic material, for example. Each of the insulation layers 11 includes a magnetic material, for example. The magnetic material is, for example, an Ni—Cu—Zn ferrite material, an Ni—Cu—Zn—Mg ferrite material, or an Ni—Cu ferrite material. In the actual element body 2, the insulation layers 11 are integrated together to such an extent that boundaries between the insulation layers 11 cannot be visually recognized. The magnetic material may include an Fe alloy, for example. Each of the insulation layers 11 may include a sintered body of a ceramic green sheet including a non-magnetic material. In this case, each of the insulation layers 11 includes a non-magnetic material.

The external electrode 4 is disposed on the end surface 2*a* of the element body 2, and the external electrode 5 is disposed on the end surface 2*b* of the element body 2. The external electrodes 4 and 5 are separated from each other in the direction in which the pair of end surfaces 2*a* and 2*b* opposes each other. The external electrodes 4 and 5 include a conductive material (for example, Ag or Pd). Each of the external electrodes 4 and 5 includes a sintered body of a conductive paste including conductive metallic powder (for example, Ag powder or Pd powder) and glass frit. A plating layer is formed on a surface of each of the external electrodes 4 and 5. The plating layer is formed by electroplating, for example. The plating layer may include a Ni plating layer. The plating layer may include a Sn plating layer.

The external electrode 4 includes five electrode portions. The external electrode 4 includes an electrode portion 4*a* on the end surface 2*a*, an electrode portion 4*b* on the side surface 2*d*, an electrode portion 4*c* on the side surface 2*c*, an electrode portion 4*d* on the side surface 2*e*, and an electrode portion 4*e* on the side surface 2*f*. The electrode portion 4*a* covers the entire end surface 2*a*. The electrode portion 4*b* covers a part of the side surface 2*d*. The electrode portion 4*c* covers a part of the side surface 2*c*. The electrode portion 4*d* covers a part of the side surface 2*e*. The electrode portion 4*e* covers a part of the side surface 2*f*. The five electrode portions 4*a*, 4*b*, 4*c*, 4*d*, and 4*e* are integrally formed.

The external electrode 5 includes five electrode portions. The external electrode 5 includes an electrode portion 5*a* on the end surface 2*b*, an electrode portion 5*b* on the side surface 2*d*, an electrode portion 5*c* on the side surface 2*c*, an electrode portion 5*d* on the side surface 2*e*, and an electrode portion 5*e* on the side surface 2*f*. The electrode portion 5*a* covers the entire end surface 2*b*. The electrode portion 5*b* covers a part of the side surface 2*d*. The electrode portion 5*c* covers a part of the side surface 2*c*. The electrode portion 5*d* covers a part of the side surface 2*e*. The electrode portion 5*e* covers a part of the side surface 2*f*. The five electrode portions 5*a*, 5*b*, 5*c*, 5*d*, and 5*e* are integrally formed.

The plurality of coil conductors 21 to 24 and the plurality of lead conductors 25 and 26 are disposed in the element body 2. The coil conductors 21 to 24 and the lead conductors 25 and 26 are disposed and separated from each other in the lamination direction. The insulation layer 11 is disposed between the coil conductors 21 to 24 and the lead conductors 25 and 26. The coil conductors 21 to 24 and the lead conductors 25 and 26 are approximately identical in thickness in the lamination direction. The coil conductors 21 to 24 and the lead conductors 25 and 26 are disposed to overlap each other in the lamination direction with the insulation layers 11 therebetween. The lamination direction constitutes a first direction, for example.

The coil conductors 21 to 24 are disposed in the lamination direction in the order of the coil conductor 21, the coil conductor 22, the coil conductor 23, and the coil conductor 24. The coil conductor 21 is located between the lead conductor 25 and the coil conductor 22 in the lamination direction. The coil conductor 21 is adjacent to the lead conductor 25 and the coil conductor 22 in the lamination direction. The coil conductor 22 is located between the coil conductor 21 and the coil conductor 23 in the lamination direction. The coil conductor 22 is adjacent to the coil conductor 21 and the coil conductor 23 in the lamination direction. The coil conductor 23 is located between the coil conductor 22 and the coil conductor 24 in the lamination direction. The coil conductor 23 is adjacent to the coil conductor 22 and the coil conductor 24 in the lamination direction. The coil conductor 24 is located between the coil conductor 23 and the lead conductor 26 in the lamination direction. The coil conductor 24 is adjacent to the coil conductor 23 and the lead conductor 26 in the lamination direction.

The coil conductors 21 to 24 include respectively coil portions 21*a* to 24*a*, pad portions 21*b* to 24*b*, and pad portions 21*c* to 24*c*. Each of the coil portions 21*a* to 24*a* is wound in an approximately rectangular shape in a planar view. The pad portions 21*b* to 24*b* are disposed respectively at one end of the coil portions 21*a* to 24*a*. The pad portions 21*c* to 24*c* are disposed respectively at the other end of the coil portions 21*a* to 24*a*. The pad portions 21*b* to 24*b* and 21*c* to 24*c* are larger in width than the coil portions 21*a* to 24*a* when viewed from the lamination direction. The width refers to a length orthogonal to the direction in which the coil portions 21*a* to 24*a* extend when viewed from the lamination direction. The pad portions 21*b* to 24*b* and 21*c* to 24*c* are equivalent in width. When viewed from the lamination direction, the pad portions 21*b* to 24*b* and 21*c* to 24*c* protrude only inward of the corresponding coil portions 21*a* to 24*a*.

The pad portions 21*b* to 24*b* and 21*c* to 24*c* are made large in width to improve the connectivity between the pad portions adjacent to each other in the lamination direction (the pad portion 21*c* and pad portion 22*b*, the pad portion 22*c* and pad portion 23*b*, and the pad portion 23*c* and pad portion 24*b*) via through-hole conductors 12*a* to 12*c*. To ensure the desired L value, the coil portions 21*a* to 24*a* are made smaller in width than the pad portions 21*b* to 24*b* and 21*c* to 24*c*. In a case in which the coil portions 21*a* to 24*a* are smaller in width than the pad portions 21*b* to 24*b* and 21*c* to 24*c*, inner diameters of the coil portions 21*a* to 24*a* are not too small. Each of the coil conductors 21 to 24 has no constant width. The widths of the coil conductors 21 to 24 are small in the coil portions 21*a* to 24*a* and are large in the pad portions 21*b* to 24*b* and 21*c* to 24*b*.

The ends of the coil conductors 21 to 24 adjacent to each other in the lamination direction are electrically connected together via the through-hole conductors 12*a* to 12*c*. The pad portion 21*c* and the pad portion 22*b* are connected by the through-hole conductor 12*a* and overlap each other when viewed from the lamination direction. The pad portion 22*c* and the pad portion 23*b* are connected by the through-hole conductor 12*b* and overlap each other when viewed from the lamination direction. The pad portion 23*c* and the pad portion 24*b* are connected by the through-hole conductor 12*c* and overlap each other when viewed from the lamination direction.

The ends of the coil conductors 21 to 24 are coupled together by the corresponding through-hole conductors 12*a* to 12*c*, so that a spiral coil 20 is configured in the element body 2. The multilayer coil component 1 includes the coil 20 in the element body 2. The coil 20 includes the plurality of coil conductors 21 to 24 that is separated from each other in the lamination direction and is electrically connected to each other. The coil 20 has an axis along the lamination direction.

Among the coil conductors 21 to 24, the coil conductor 21 is closest to the side surface 2*c* in the lamination direction. The pad portion 21*b* constitutes one end E1 of the coil 20. Among the coil conductors 21 to 24, the coil conductor 24 is closest to the side surface 2*d* in the lamination direction. The pad portion 24*c* constitutes the other end E2 of the coil 20.

The lead conductor 25 is disposed closer to the side surface 2*c* than the coil conductor 21 in the lamination direction. An end portion 25*e* of the lead conductor 25 is connected to the pad portion 21*b* by the through-hole conductor 12*d*. The lead conductor 25 and the one end E1 of the coil 20 are connected together by the through-hole conductor 12*d*.

An end portion 25*a* of the lead conductor 25 is exposed to the end surface 2*b* of the element body 2 and is connected to the electrode portion 5*a* covering the end surface 2*b*. The lead conductor 25 and the external electrode 5 are directly connected to each other. The one end E1 of the coil 20 and the external electrode 5 are electrically connected through the lead conductor 25 and the through-hole conductor 12*d*.

The lead conductor 26 is disposed closer to the side surface 2*d* than the coil conductor 24 in the lamination direction. An end portion 26*e* of the lead conductor 26 is connected to the pad portion 24*c* by the through-hole conductor 12*e*. The lead conductor 26 and the other end E2 of the coil 20 are connected together by the through-hole conductor 12*e*.

An end portion 26*a* of the lead conductor 26 is exposed to the end surface 2*a* of the element body 2 and is connected to the electrode portion 4*a* covering the end surface 2*a*. The lead conductor 26 and the external electrode 4 are directly connected to each other. The other end E2 of the coil 20 and the external electrode 4 are electrically connected through the lead conductor 26 and the through-hole conductor 12*e*.

When viewed from the lamination direction, the coil portions 21*a* to 24*a* include linearly extending straight portions and bent portions. When viewed from the lamination direction, the straight portion of the coil portion 21*a* includes a portion overlapping the pad portion 22*c* adjacent in the lamination direction. When viewed from the lamination direction, the coil portion 21*a* includes a non-overlapping portion $\mathbf{21}a_1$ not overlapping the pad portion 22*c* and an overlapping portion $\mathbf{21}a_2$ overlapping the pad portion 22*c*. The non-overlapping portion $\mathbf{21}a_1$ has an approximately constant width W1 (see FIG. 3A). The overlapping portion $\mathbf{21}a_2$ has a width W2 larger than the width W1 (see FIG. 3A). The non-overlapping portion $\mathbf{21}a_1$ constitutes a first portion, for example, and the overlapping portion $\mathbf{21}a_2$ constitutes a third portion, for example.

When viewed from the lamination direction, one bent portion of the coil portion 22*a* overlaps the pad portion 21*b* adjacent in the lamination direction. When viewed from the lamination direction, another bent portion of the coil portion 22*a* overlaps the pad portion 23*c* adjacent in the lamination direction. The straight portion of the coil portion 22*a* includes no portion overlapping the pad portions 21*b*, 21*c*, 23*b*, and 23*c* adjacent in the lamination direction. The coil portion 22*a* has entirely an approximately constant width W1 (see FIG. 3B). The width W1 of the coil portion 22*a* is equivalent to the width W1 of the non-overlapping portion $\mathbf{21}a_1$. In the present specification, the ten "equivalent" does not necessarily mean only that values are exactly equal to each other. Even when a minute difference within a predetermined range, a manufacturing error, or a measurement error is included in the values, the values may be regarded as being equivalent to each other.

When viewed from the lamination direction, one bent portion of the coil portion 23*a* overlaps the pad portion 22*b* adjacent in the lamination direction. When viewed from the lamination direction, another bent portion of the coil portion 23*a* overlaps the pad portion 24*c* adjacent in the lamination direction. The straight portion of the coil portion 23*a* includes no portion overlapping the pad portions 22*b*, 22*c*, 24*b*, and 24*c* adjacent in the lamination direction. The coil portion 23*a* has entirely an approximately constant width W1 (see FIG. 4A). The width W1 of the coil portion 23*a* is equivalent to the width of the non-overlapping portion 21$a_1$.

When viewed from the lamination direction, the straight portion of the coil portion 24*a* includes a portion overlapping the pad portion 23*b* adjacent in the lamination direction. When viewed from the lamination direction, the coil portion 24*a* includes a non-overlapping portion 24$a_1$ not overlapping the pad portion 23*b* and an overlapping portion 24$a_2$ overlapping the pad portion 23*b*. The non-overlapping portion 24$a_1$ has an approximately constant width W1 (see FIG. 4B). The width W1 of the non-overlapping portion 24$a_1$ is equivalent to the width of the non-overlapping portion 21$a_1$. The overlapping portion 24$a_2$ has a width W2 larger than the width W1 (see FIG. 4B). The non-overlapping portion 24$a_1$ constitutes a first portion, for example, and the overlapping portion 24$a_2$ constitutes a third portion, for example.

Figure 3A:
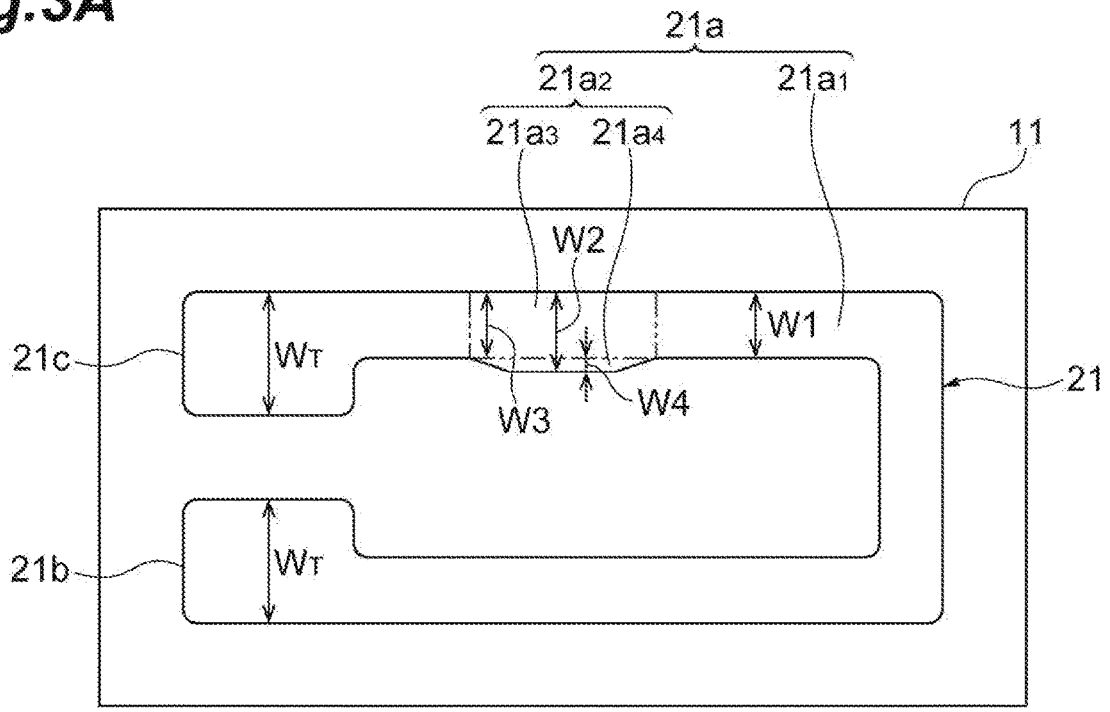
FIGS. 3A and 3B are plan views of coil conductors.
Figure 3B:
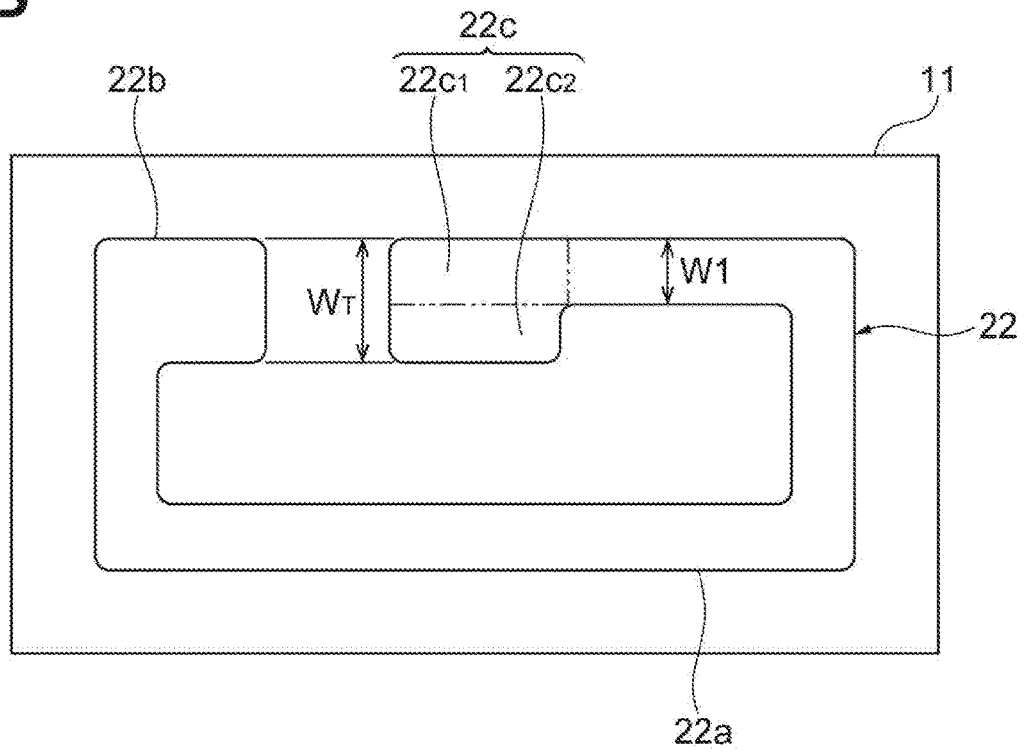
Figure 4A:
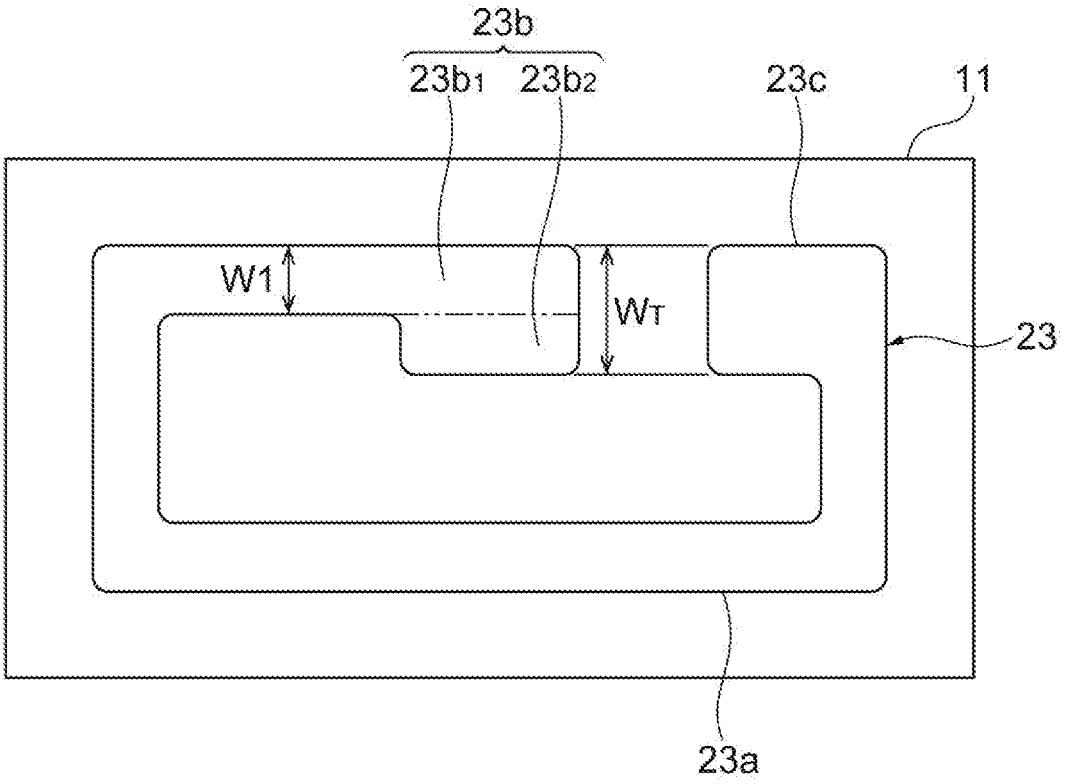
FIGS. 4A and 4B are plan views of coil conductors.
Figure 4B:
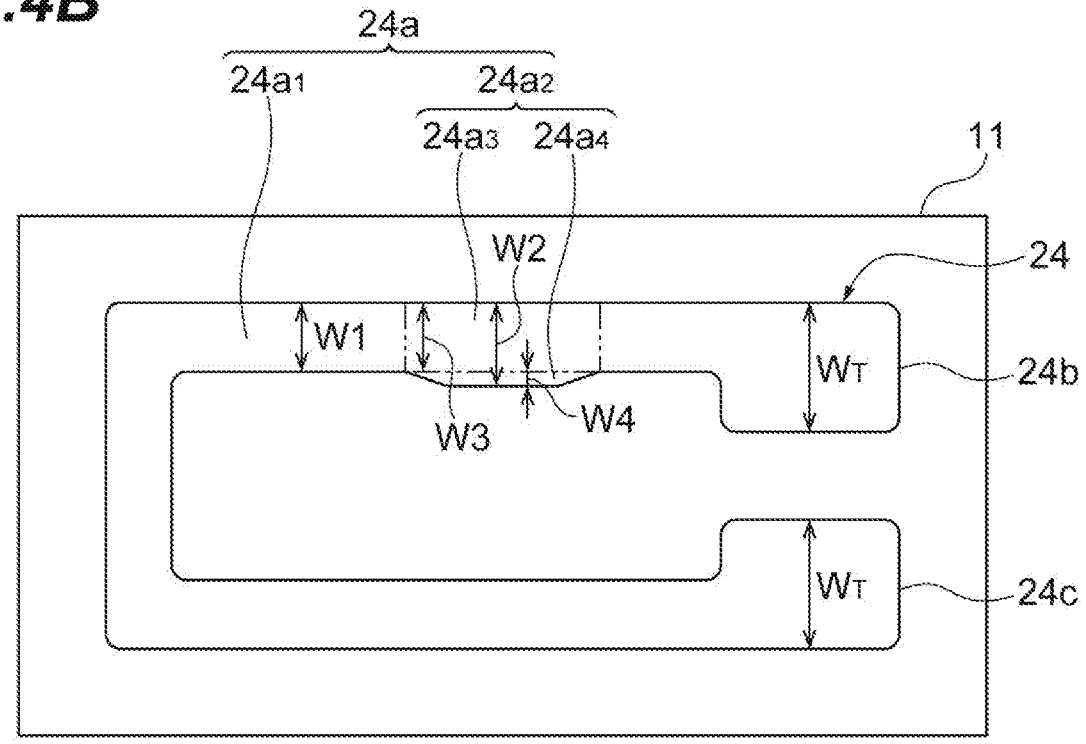

The overlapping portions 21$a_2$ and 24$a_2$ will be described below with reference to FIGS. 3A, 3B, 4A, and FIG. 4B. FIGS. 3A, 3B, 4A, and FIG. 4B are plan views of the coil conductors. FIG. 3A illustrates the coil conductor 21, FIG. 3B illustrates the coil conductor 22, FIG. 4A illustrates the coil conductor 23, and FIG. 4B illustrates the coil conductor 24.

As illustrated in FIG. 3A, the overlapping portion 21$a_2$ includes a predetermined width portion 21$a_3$ and an extended width portion 21$a_4$. The predetermined width portion 21$a_3$ has an approximately rectangular shape. The predetermined width portion 21$a_3$ has an approximately constant width W3. The width W3 of the predetermined width portion 21$a_3$ is equivalent to the width W1 of the non-overlapping portion 21$a_1$. The width W3 of the predetermined width portion 21$a_3$ is smaller than widths $W_T$ of the pad portions 21*b*, 21*c*, 22*b*, and 22*c*. The predetermined width portion 21$a_3$ constitutes a second portion, for example, and the extended width portion 21$a_4$ constitutes a second internal conductor, for example.

The predetermined width portion 21$a_3$ overlaps a part of the pad portion 22*c* when viewed from the lamination direction. Therefore, as illustrated in FIG. 3B, the pad portion 22*c* includes a portion 22$c_1$ overlapping the predetermined width portion 21$a_3$ and a portion 22$c_2$ not overlapping the predetermined width portion 21$a_3$ when viewed from the lamination direction. The portion 22$c_2$ is a portion protruding from the predetermined width portion 21$a_3$ when viewed from the lamination direction.

As illustrated in FIG. 3A, the extended width portion 21$a_4$ is formed integrally with the predetermined width portion 21$a_3$. The extended width portion 21$a_4$ is disposed on the same layer as the predetermined width portion 21$a_3$ and constitutes a part of the coil conductor 21. The extended width portion 21$a_4$ and the predetermined width portion 21$a_3$ are connected together. The extended width portion 21$a_4$ is continuous with the predetermined width portion 21$a_3$. When viewed from the lamination direction, the extended width portion 21$a_4$ protrudes inward from the predetermined width portion 21$a_3$ and is positioned inside the predetermined width portion 21$a_3$. The extended width portion 21$a_4$ partially increases the width of the coil portion 21*a*. The extended width portion 21$a_4$ is positioned to overlap the portion 22$c_2$ of the pad portion 22*c* when viewed from the lamination direction. The extended width portion 21$a_4$ is formed to increase an area of a region of the coil portion 21*a* overlapping the pad portion 22*c* in the lamination direction. The entire overlapping portion 21$a_2$ (the entire predetermined width portion 21$a_3$ and the entire extended width portion 21$a_4$) overlaps the pad portion 22*c*.

The extended width portion 21$a_4$ has an approximately trapezoidal shape. The extended width portion 21$a_4$ is shaped to become gradually narrower inward from the boundary with the predetermined width portion 21$a_3$. A length of the extended width portion 21$a_4$ in the direction orthogonal to the width direction is the largest at the boundary with the predetermined width portion 21$a_3$ and becomes smaller inward from the boundary with the predetermined width portion 21$a_3$. The length orthogonal to the width direction will be hereinafter called simply "length". The maximum length of the extended width portion 21$a_4$ is equivalent to the length of the predetermined width portion 21$a_3$.

The extended width portion 21$a_4$ has a width W4 smaller than the width W1 of the predetermined width portion 21$a_3$. The width W4 of the extended width portion 21$a_4$ is the maximum width of the extended width portion 21$a_4$, for example. The sum of the width W3 of the predetermined width portion 21$a_3$ and the width W4 of the extended width portion 21$a_4$ is equivalent to the width W2 of the overlapping portion 21$a_2$. The width W2 of the overlapping portion 21$a_2$ is the maximum width of the overlapping portion 21$a_2$. The width W2 of the overlapping portion 21$a_2$ is larger than the width W1 of the non-overlapping portion 21$a_1$. Therefore, the width of the coil portion 21*a* is partly increased. The width W2 of the overlapping portion 21$a_2$ is smaller than the width $W_T$ of the pad portion 22*c*, and thus the inner diameter of the coil portion 21*a* is not too small. That is, an area of a region inside the coil portion 21*a* through which magnetic flux passes is not too small.

As illustrated in FIG. 4B, the overlapping portion 24$a_2$ includes a predetermined width portion 24$a_3$ and an extended width portion 24$a_4$. The predetermined width portion 24$a_3$ has an approximately rectangular shape. The predetermined width portion 24$a_3$ has an approximately constant width W3. The width W3 of the predetermined width portion 24$a_3$ is equivalent to the width W1 of the non-overlapping portion 24$a_1$. The width W3 of the predetermined width portion 24$a_3$ is smaller than the widths $W_T$ of the pad portions 24*b*, 24*c*, 23*b*, and 23*c*. The predetermined width portion 24$a_3$ constitutes a second portion, for example, and the extended width portion 24$a_4$ constitutes a second internal conductor, for example.

The predetermined width portion 24$a_3$ overlaps a part of the pad portion 23*b* when viewed from the lamination direction. Therefore, as illustrated in FIG. 4A, the pad portion 23*b* includes a portion 23$b_1$ overlapping the predetermined width portion 24$a_3$ and a portion 23$b_2$ not overlapping the predetermined width portion 24$a_3$. The portion 23$b_2$ is a portion protruding from the predetermined width portion 24$a_3$ when viewed from the lamination direction.

As illustrated in FIG. 4B, the extended width portion 24$a_4$ is formed integrally with the predetermined width portion 24$a_3$. The extended width portion 24$a_4$ is disposed on the same layer as the predetermined width portion 24$a_3$ and constitutes a part of the coil conductor 24. The extended width portion 24$a_4$ and the predetermined width portion 24$a_3$ are connected together. The extended width portion 24$a_4$ is continuous with the predetermined width portion 24$a_3$. When viewed from the lamination direction, the extended width portion 24$a_4$ protrudes inward from the predetermined width portion 24$a_3$ and is positioned inside the predetermined width portion 24$a_3$. The extended width portion 24$a_4$ partially increases the width of the coil portion 24*a*. The extended width portion 24$a_4$ is positioned to overlap the portion 23$b_2$ of the pad portion 23*b* when viewed from the lamination direction. The extended width part 24$a_4$ is formed to increase an area of a region of the coil portion 24*a* overlapping the pad portion 23*b* in the lamination direction. The entire overlapping portion 24$a_2$ (the entire predetermined width portion 24$a_3$ and the entire extended width portion 24$a_4$) overlaps the pad portion 23*b*.

The extended width portion 24$a_4$ has an approximately trapezoidal shape. The extended width portion 24$a_4$ is shaped to become gradually narrower inward from the boundary with the predetermined width portion 24$a_3$. A length of the extended width portion 24$a_4$ is the largest at the boundary with the predetermined width portion 24$a_3$ and becomes smaller inward from the boundary with the predetermined width portion 24$a_3$. The maximum length of the extended width portion 21$a_4$ is equivalent to the length of the predetermined width portion 21$a_3$.

The extended width portion 24$a_4$ has a width W4 smaller than the width W3 of the predetermined width portion 24$a_3$. The width W4 of the extended width portion 24$a_4$ is the maximum width of the extended width portion 24$a_4$, for example. The sum of the width W3 of the predetermined width portion 24$a_3$ and the width W4 of the extended width portion 24$a_4$ is equivalent to the width W2 of the overlapping portion 24$a_2$. The width W2 of the overlapping portion 24$a_2$ is the maximum width of the overlapping portion 24$a_2$. The width W2 of the overlapping portion 24$a_2$ is larger than the width W1 of the non-overlapping portion 24$a_1$. Therefore, the width of the coil portion 24*a* is partially increased. The width W2 of the overlapping portion 24$a_2$ is smaller than the width $W_T$ of the pad portion 23*b*, and thus the inner diameter of the coil portion 24*a* is not too small. That is, an area of a region inside the coil portion 24*a* through which magnetic flux passes is not too small.

Each of the coil conductors 21 to 24, the lead conductors 25 and 26, and the through-hole conductors 12*a* to 12*e* includes a conductive material (for example, Ag or Pd). Each of the coil conductors 21 to 24, the lead conductors 25 and 26, the through-hole conductors 12*a* to 12*e* includes a sintered body of a conducive paste including conductive metallic powder (for example, Ag powder or Pd powder). Each of the coil conductors 21 to 24, the lead conductors 25 and 26, the through-hole conductors 12*a* to 12*e* may include a metallic oxide (for example, $TiO_2$, $Al_2O_3$, or $ZrO_2$). In this case, each of the coil conductors 21 to 24, the lead conductors 25 and 26, the through-hole conductors 12*a* to 12*e* includes a sintered body of a conductive paste further including the metallic oxide. In a case, in which the conductive paste includes the metallic oxide, a contraction factor of the conductive paste at the time of firing is small.

Next, the producing process of the multilayer coil component 1 will be described below with reference to FIGS. 5A and 5B.

Figure 5A:
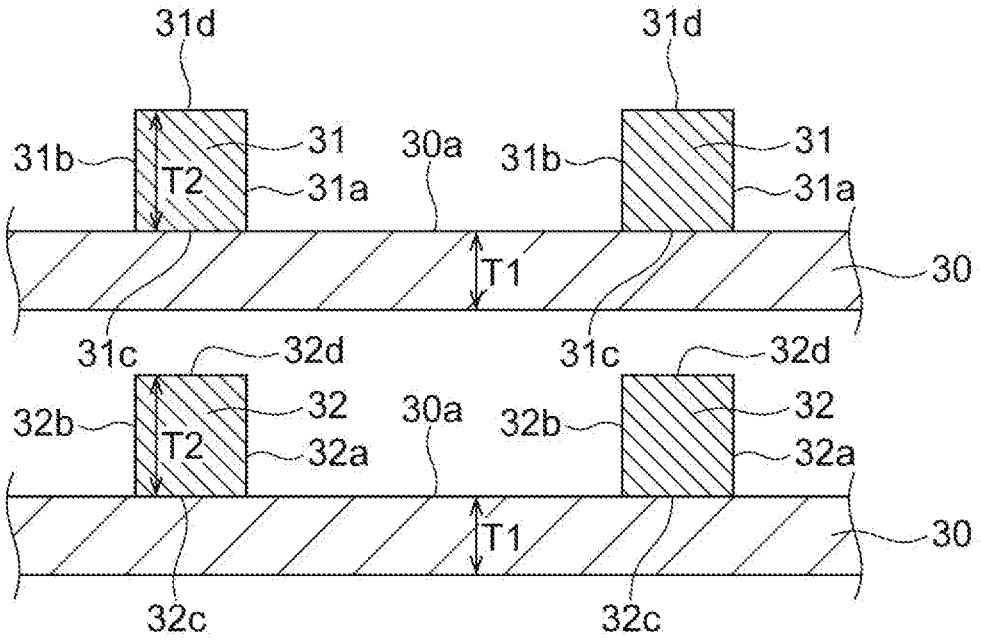
FIGS. 5A and 5B are cross-sectional views of conductor patterns.
Figure 5B:
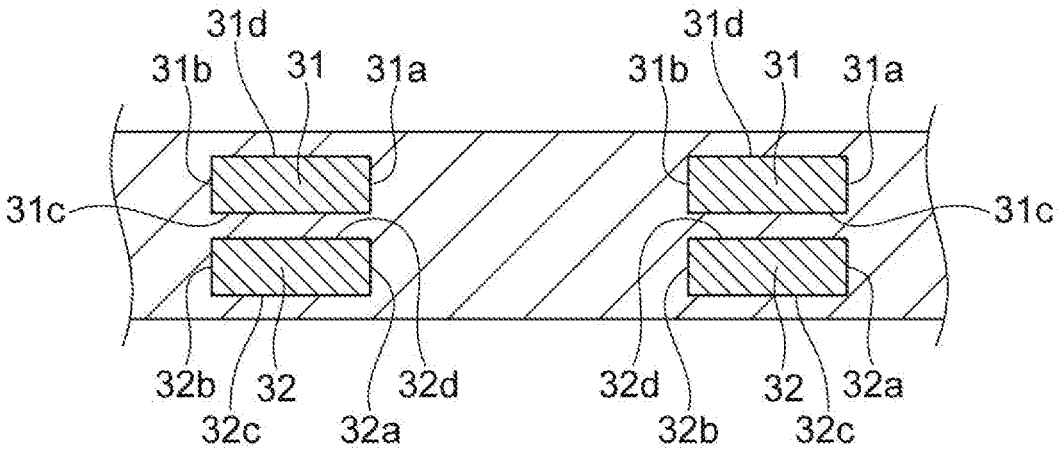

FIGS. 5A and 5B are cross-sectional views of conductor patterns. FIGS. 5A and 5B illustrate a conductor pattern 31 to be the coil conductor 21 and a conductor pattern 32 to be the coil conductor 22 as an example. FIGS. 5A and 5B illustrate cross-sections of the conductor patterns 31 and 32 taken at the positions corresponding to the non-overlapping portion 21$a_1$ of the coil portion 21*a*. The cross-section of a conductor pattern to be the coil conductor 23 and the cross-section of a conductor pattern to be the coil conductor 24 are the same as the cross-sections of the conductor patterns 31 and 32, and thus illustrations and descriptions thereof will be omitted. FIG. 5A illustrates the conductor patterns 31 and 32 before the lamination and crimping, and FIG. 5B illustrates the conductor patterns 31 and 32 after the lamination and crimping.

First, an insulator slurry is prepared. The insulator slurry contains ferrite powder as a main component of the element body 2 and a binder resin. The prepared insulator slurry is applied to a base to form an insulator green sheet 30 to be the insulation layer 11. Hereinafter, the insulator green sheet will be called simply "green sheet". The insulator slurry is applied by doctor blade method, for example. The base is a PET film, for example. The green sheet 30 includes a main surface 30*a*. Next, through-holes are formed in the green sheet 30 at the positions where the through-hole conductors 12*a* to 12*e* (see FIG. 2) are to be formed. The through-holes are formed by laser processing, for example.

Next, a first conductive paste is filled into the through-holes in the green sheet 30. The first conductive paste contains a conductive metallic powder and a binder resin. Next, the conductor pattern to be any of the coil conductors 21 to 24 and the lead conductors 25 and 26 is provided on the main surface 30*a* of the green sheet 30. The conductor pattern is formed by applying the first conductive paste. The conductor pattern is connected to the conductive paste in the through-holes.

The conductor patterns to be the coil conductors 21 to 24 are approximately identical in shape to the coil conductors 21 to 24 described above in a planar view, and thus illustrations thereof in a plane view will be omitted. The conductor patterns to be the coil conductors 21 to 24 include coil conductor patterns to be the coil portions 21*a* to 24*a* and pad conductor patterns to be the pad portions 21*b* to 24*b* and 21*c* to 24*c*. In a planar view, the pad conductor patterns are larger in width than the coil conductor patterns. The coil conductor patterns include non-overlapping portion conductor patterns to be the non-overlapping portions 21$a_1$ and 24$a_1$ and overlapping portion conductor patterns to be the overlapping portions 21$a_2$ and 24$a_2$. The overlapping portion conductor patterns include predetermined width portion conductor patterns to be the predetermined width portions 21$a_3$ and 24$a_3$ and extended width portion conductor patterns to be the extended width portions 21$a_4$ and 24$a_4$. In the process of providing the conductor patterns, the extended width portion conductor patterns are formed integrally with the predetermined width portion conductor patterns on the same layer. In a planar view, the predetermined width portion conductor patterns are equivalent in width to the non-overlapping portion conductor patterns. The overlapping portion conductor patterns are larger in width than the non-overlapping portion conductor patterns, and are smaller in width than the pad conductor patterns.

As illustrated in FIG. 5A, the cross-sections of the conductor patterns 31 and 32 have a rectangular shape. The conductor pattern 31 includes a pair of side surfaces 31*a* and 31*b* and a pair of side surfaces 31*c* and 31*d*. The pair of side surfaces 31*a* and 31*b* opposes each other in the width direction (in a direction along the main surface 30*a*). The pair of side surfaces 31*c* and 31*d* opposes each other in a height direction (in a direction orthogonal to the main surface 30*a*). The width direction corresponds to a direction orthogonal to the lamination direction, and the height direction corresponds to the lamination direction. The conductor pattern 32 includes a pair of side surfaces 32*a* and 32*b* and a pair of side surfaces 32*c* and 32*d*. The pair of side surfaces 32*a* and 32*b* opposes each other in the width direction. The pair of side surfaces 32*c* and 32*d* opposes each other in the height direction. The side surfaces 31*c* and 32*c* contact the main surface 30*a* of the green sheet 30 in the process of providing the conductor pattern.

The conductor patterns 31 and 32 has a height-to-width ratio (aspect ratio) of about 1.0, for example. The cross-sections of the conductor patterns 31 and 32 have an approximately regular square shape.

In the process of providing the conductor patterns, a thickness T2 of the conductor patterns 31 and 32 is set to be a value not too large relative to a thickness T1 of the green sheet 30. For example, after the process of providing the conductor patterns and before the process of laminating the green sheets 30, a ratio of the thickness T2 of the conductor patterns 31 and 32 to the thickness T1 of the green sheet 30 is 1.1 to 2.0 inclusive.

In the process of providing the conductor patterns, the conductor patterns are provided such that a ratio of the width of the non-overlapping portion conductors to the width of the pad conductor patterns falls within a predetermined range. For example, after the process of providing the conductor patterns and before the process of laminating the green sheets 30, the ratio of the width of the non-overlapping portion conductor patterns to the width of the pad conductor patterns is 0.35 to 0.6 inclusive. The width of the pad conductor patterns corresponds to the widths $W_T$ of the pad portions 21*b*, 24*b*, 21*c*, and 24*c*, for example. The width of the non-overlapping portion conductor patterns corresponds to the width W1 of the non-overlapping portion conductor patterns 21$a_1$ and 24$a_1$. When the ratio of the width of the non-overlapping portion conductor patterns to the width of the pad conductor patterns is equal to or less than 0.6, the width of the non-overlapping portion conductor patterns is as small as possible, and thus the inner diameters of the coil portions 21*a* and 24*a* increase. This increases the area of the region inside the coil portions 21*a* and 24*a* through which magnetic flux passes.

When the ratio of the width of the non-overlapping portion conductor patterns to the width of the pad conductor patterns is smaller than 0.35, the width of the non-overlapping portion conductor patterns is small, and thus a ratio of the width of the pad conductor patterns to the width of the non-overlapping portion conductor patterns is too large. Therefore, when viewed from the lamination direction, areas of the regions of the pad portions 21*b*, 24*b*, 21*c*, and 24*c* not overlapping the coil portions 22*a* and 23*a* are too large. In this case, the pad portions 21*b*, 24*b*, 21*c*, and 24*c* may inhibit the magnetic flux to decrease impedance. In the present embodiment, however, the ratio of the width of the non-overlapping portion conductor patterns to the width of the pad conductor patterns is equal to or more than 0.35, the ratio of the width of the pad conductor patterns to the width of the non-overlapping portion conductor patterns is not too large. Therefore, the areas of the regions of the pad portions 21*b*, 24*b*, 21*c*, and 24*c* not overlapping the coil portions 22*a* and 23*a* are not too large, thereby suppressing decrease in the impedance. The lower limit of the ratio of the width of the non-overlapping portion conductor patterns to the width of the pad conductor patterns may be equal to or more than 0.45. In a case in which the lower limit of the ratio is equal to or more than 0.45, the areas of the regions of the pad portions 21*b*, 24*b*, 21*c*, and 24*c* not overlapping the coil portions 22*a* and 23*a* are much smaller, thereby further suppressing decrease in the impedance.

Next, the green sheets 30 are laminated. In this process, the plurality of green sheets 30 is separated from the bases and laminated, and then the laminated plurality of green sheets 30 is pressurized in the lamination direction. Consequently, the laminated body formed from the plurality of green sheets 30 is obtained. The green sheets 30 are laminated such that the conductor patterns to be the coil conductors 21 to 24 and the lead conductors 25 and 26 overlap each other in the lamination direction. The laminated body includes therein the conductor patterns to be the coil conductors 21 to 24 and the lead conductors 25 and 26.

In the process of laminating the green sheets 30, the plurality of green sheets 30 is laminated as described below. When viewed from the lamination direction, the predetermined width portion conductor patterns overlap some parts of the pad conductor patterns, and when viewed from the lamination direction, the extended width portion conductor patterns overlap the portions of the pad conductor patterns not overlapping the predetermined width portion conductor patterns.

In the process of laminating the green sheets 30, the conductor patterns 31 and 32 are pressurized in the lamination direction and sandwiched between the green sheets 30. The conductor patterns 31 and 32 are subject to a force from the lamination direction. Therefore, as illustrated in FIG. 5B, the conductor patterns 31 and 32 deform in the lamination direction. In a state in which the conductor patterns 31 and 32 deform, the aspect ratio of each of the conductor patterns 31 and 32 is about 0.3, for example.

Next, the laminated body of the green sheets 30 is cut into a plurality of chips of a predetermined size. Consequently, the plurality of green ships is obtained. The laminated body is cut by a cutting machine. Next, the binder resin is removed from the green chips, and then the green chips are fired. Consequently, the element body 2 is obtained. The cross-section shape of the coil conductors 21 and 22 is approximately equal to the cross-section shape of the conductor patterns 31 and 32. The conductor patterns 31 and 32 contract at a predetermined contraction factor due to firing. The coil conductors 21 and 22 contract at the predetermined contraction factor due to the contraction of the conductor patterns 31 and 32. The predetermined contraction factor is about 0.1, for example.

Next, a second conductive paste is applied to the element body 2. The second conductive paste is applied to the end surfaces 2*a* and 2*b* of the element body 2. The second conductive paste contains conductive metallic powder, glass frit, and a binder resin. Then, the second conductive paste is sintered on the element body 2 by heat treatment. Consequently, the pair of external electrodes 4 and 5 is formed on the element body 2. A plating layer may be formed on the surfaces of the external electrodes 4 and 5.

By the foregoing process, the multilayer coil component 1 is obtained.

As described above, in the present embodiment, when viewed from the lamination direction, the predetermined width portion 21$a_3$ and the extended width portion 21$a_4$ overlap the pad portion 22*c* adjacent in the lamination direction. In the multilayer coil component 1, the area of the region where the coil conductor 21 and the coil conductor 22 adjacent to each other in the lamination direction overlap each other is large, as compared with in a configuration in which only the predetermined width portion 21$a_3$ overlaps the pad portion 22*c*. Therefore, the coil conductor 21 and the coil conductor 22 tend not to deviate from each other in the direction orthogonal to the lamination direction. That is, a position deviation between the coil conductor 21 and the coil conductor 22 tends not to occur. This position deviation is a phenomenon that the position of the coil conductor 21 and the position of the coil conductor 22 deviate from each other in the direction orthogonal to the lamination direction. When viewed from the lamination direction, the predetermined width portion 24$a_3$ and the extended width portion 24$a_4$ overlap the pad portion 23$b$ adjacent in the lamination direction. In the multilayer coil component 1, the area of the region where the coil conductor 23 and the coil conductor 24 adjacent to each other in the lamination direction overlap each other is large, as compared with in a configuration in which only the predetermined width portion 24$a_3$ overlaps the pad portion 23$b$. Therefore, the coil conductor 23 and the coil conductor 24 tend not to deviate from each other in the direction orthogonal to the lamination direction. That is, a position deviation between the coil conductor 23 and the coil conductor 24 tends not to occur. This position deviation is a phenomenon that the position of the coil conductor 23 and the position of the coil conductor 24 deviate from each other in the direction orthogonal to the lamination direction. Consequently, the multilayer coil component 1 suppresses laminate deviation.

In the multilayer coil component 1, the width W2 of the overlapping portions 21$a_2$ and 24$a_2$ is larger than the width W1 of the non-overlapping portions 21$a_1$ and 24$a_1$. Since the width W2 is larger than the width W1, the area of the region where the coil conductors 21 to 24 adjacent to each other in the lamination direction overlap each other are large. Therefore, the multilayer coil component 1 reliably suppresses laminate deviation.

In the multilayer coil component 1, the width W2 of the overlapping portions 21$a_2$ and 24$a_2$ is smaller than the width $W_T$ of the pad portions 22$c$ and 23$b$ adjacent to each other in the lamination direction. In this case, the area of the region inside the coil portions 21$a$ and 24$a$ through which magnetic flux passes tends not to decrease. Therefore, the multilayer coil component 1 ensures the desired L value.

In the multilayer coil component 1, the entire extended width portion 21$a_4$ overlaps the portion 22$c_2$ of the pad portion 22$c$ adjacent in the lamination direction. The entire extended width portion 24$a_4$ overlaps the portion 23$b_2$ of the pad portion 23$b$ adjacent in the lamination direction. In this case, the area of the region inside the coil portions 21$a$ and 24$a$ through which magnetic flux passes tends not to decrease. Therefore, the multilayer coil component 1 ensures the desired L value.

In the present embodiment, in the process of laminating the green sheets 30, when viewed from the lamination direction, the green sheets 30 are laminated such that the predetermined width portion conductor patterns and the extended width portion conductor patterns overlap the pad conductor patterns adjacent in the lamination direction. In the producing process of the multilayer coil component 1, the area of the region where the conductor patterns adjacent to each other in the lamination direction overlap each other is large, as compared with in a process of laminating the green sheets such that only the predetermined width portion conductor patterns overlap the pad conductor patterns. Therefore, the conductor patterns adjacent to each other in the lamination direction tend not to deviate from each other in the direction orthogonal to the lamination direction, and the producing process of the multilayer coil component 1 suppresses laminate deviation between the conductor patterns adjacent to each other in the lamination direction. Consequently, in the multilayer coil component 1, laminate deviation between the coil conductors 21 to 24 adjacent to each other in the lamination direction is suppressed.

After the process of providing the conductor patterns and before the process of lamination, in a case in which the thickness T2 of the conductor patterns 31 and 32 is too large as compared with the thickness T1 of the green sheets 30, the laminate deviation may increase. In contrast, in the producing process of the multilayer coil component 1, after the process of providing the conductor patterns and before the process of lamination, the ratio of the thickness T2 of the conductor patterns 31 and 32 to the thickness T1 of the green sheets 30 is 1.1 to 2.0 inclusive. In this case, the thickness T2 is not too large as compared with the thickness T1, thereby suppressing an increase in laminate deviation.

In the producing process of the multilayer coil component 1, after the process of providing the conductor patterns and before the process of lamination and crimping, the ratio of the width of the non-overlapping portion conductor patterns to the width of the pad conductor patterns is 0.35 to 0.6 inclusive.

In a case in which the ratio of the width of the non-overlapping portion conductor patterns to the width of the pad conductor patterns is equal to or less than 0.6, the width of the non-overlapping portion conductor patterns is as small as possible relative to the width of the pad conductor patterns, so that the area of the region inside the coil portions 21$a$ and 24$a$ through which the magnetic flux passes increases. Therefore, the multilayer coil component 1 ensures the desired L value. Even in a case in which the width of the non-overlapping portion conductor patterns is as small as possible relative to the width of the pad conductor patterns, the area of the region where the conductor patterns adjacent to each other in the lamination direction overlap each other is large as described above, so that the laminate deviation between the conductor patterns adjacent to each other in the lamination direction is suppressed. Consequently, the multilayer coil component 1 ensures the desired L value and suppresses the laminate deviation.

The ratio of the non-overlapping portion conductor patterns to the width of the pad conductor patterns is equal to or more than 0.35, and thus the ratio of the width of the pad conductor patterns to the width of the non-overlapping portion conductor patterns is not too large. Therefore, the areas of the regions of the pad portions 21$b$, 24$b$, 21$c$, and 24$c$ not overlapping the coil portions 22$a$ and 23$a$ in the first direction D1 are not too large. Consequently, the multilayer coil component 1 suppresses decrease in the impedance.

In the multilayer coil component 1, the bent portions of the coil portions 22$a$ and 23$a$ overlap the pad portions 21$b$, 23$c$, 22$b$, and 24$c$ adjacent to each other in the lamination direction. Due to the shape of the bent portions, the areas of the regions where the coil portions 22$a$ and 23$a$ and the pad portions 21$b$, 23$c$, 22$b$, and 24$c$ adjacent to each other in the lamination direction overlap each other are large, in the bent portions. Therefore, the multilayer coil component 1 suppresses laminate deviation in the bent portions.

Second Embodiment

Next, a configuration of a multilayer coil component 1A according to a second embodiment will be described with reference to FIGS. 6, 7A, 7B, 8A, and 8B. Hereinafter, differences between the multilayer coil component 1 and the multilayer coil component 1A will be mainly described.

Figure 6:
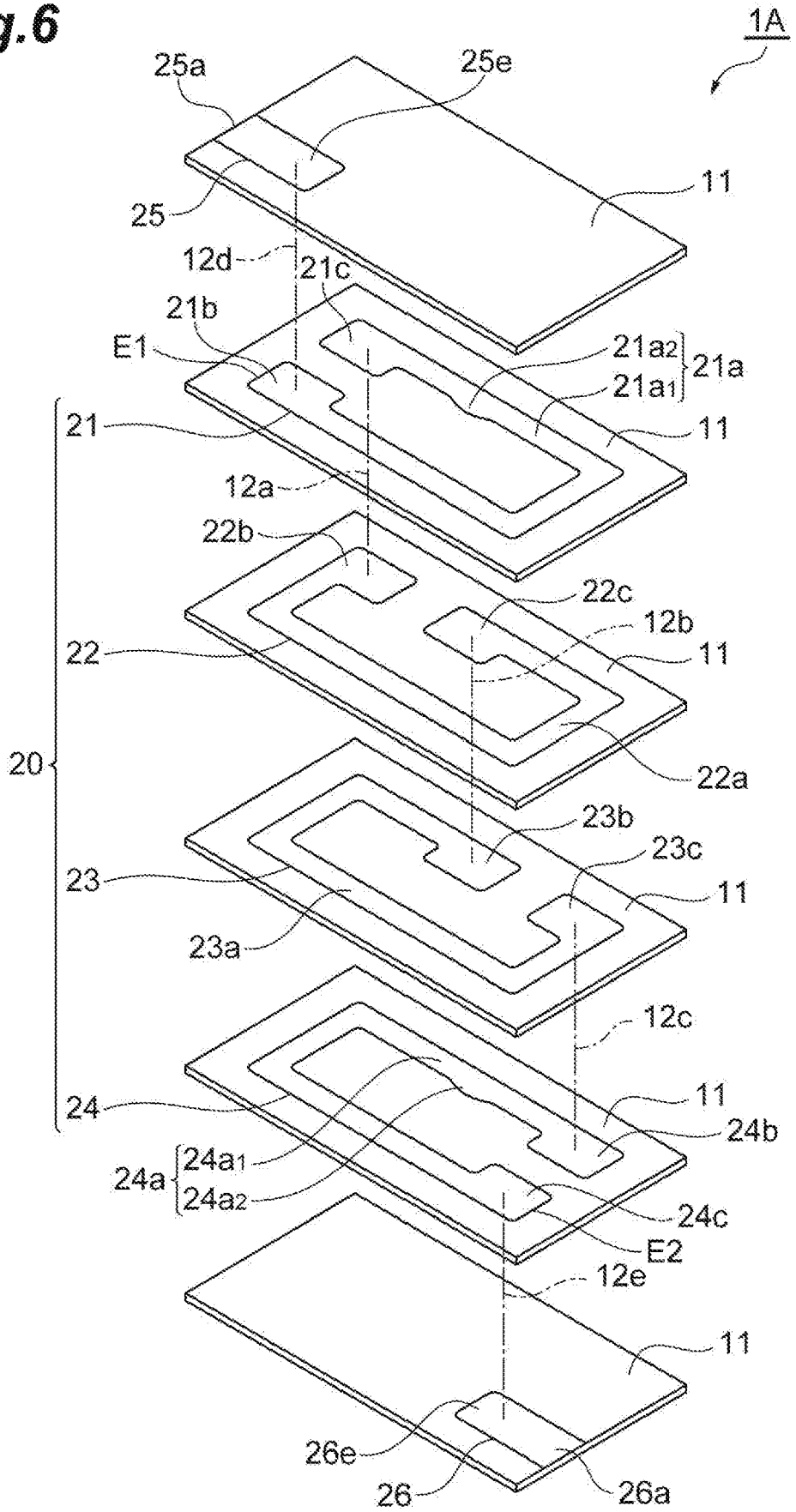
FIG. 6 is an exploded perspective view of a multilayer coil component according to a second embodiment.

FIG. 6 is an exploded perspective view of the multilayer coil component according to the second embodiment. FIGS. 7A, 7B, 8A, and 8B are plan views of coil conductors.

Similarly to the multilayer coil component 1, the multilayer coil component 1A includes the element body 2, the pair of external electrodes 4 and 5 (not illustrated), the plurality of coil conductors 21 to 24, and the plurality of lead conductors 25 and 26. In the multilayer coil component 1A, coil portions 21*a* and 24*a* (overlapping portions 21$a_2$ and 24$a_2$) are different in shape from those in the multilayer coil component 1.

Figure 7A:
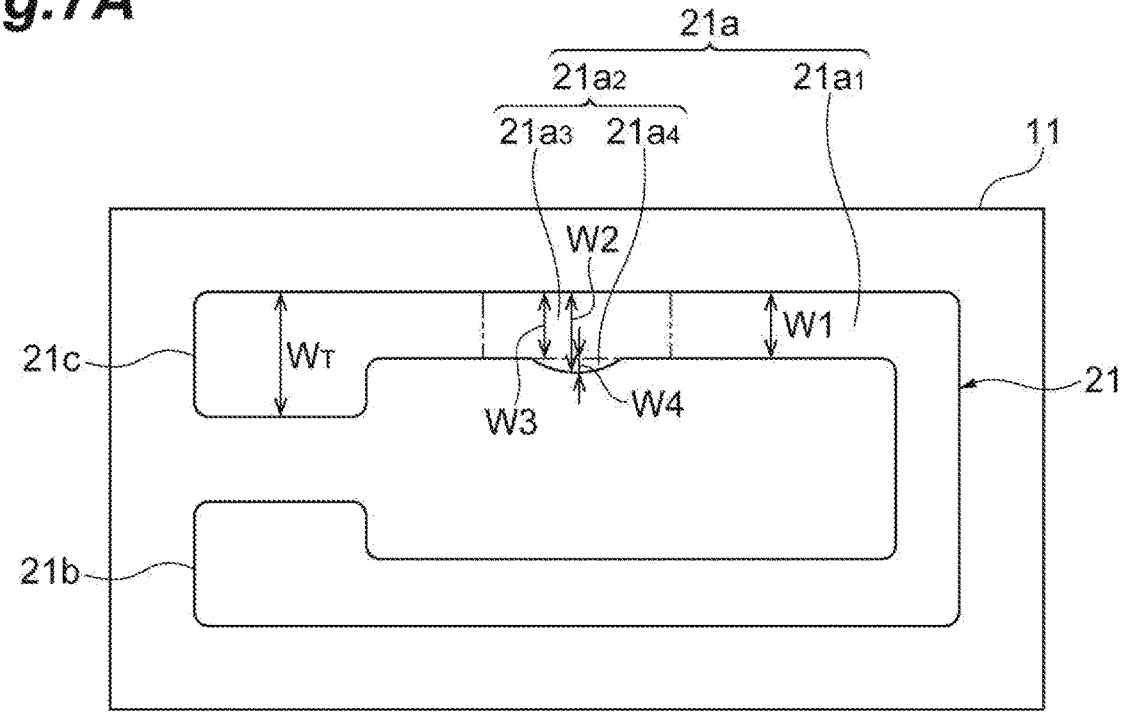
FIGS. 7A and 7B are plan views of coil conductors.
Figure 7B:
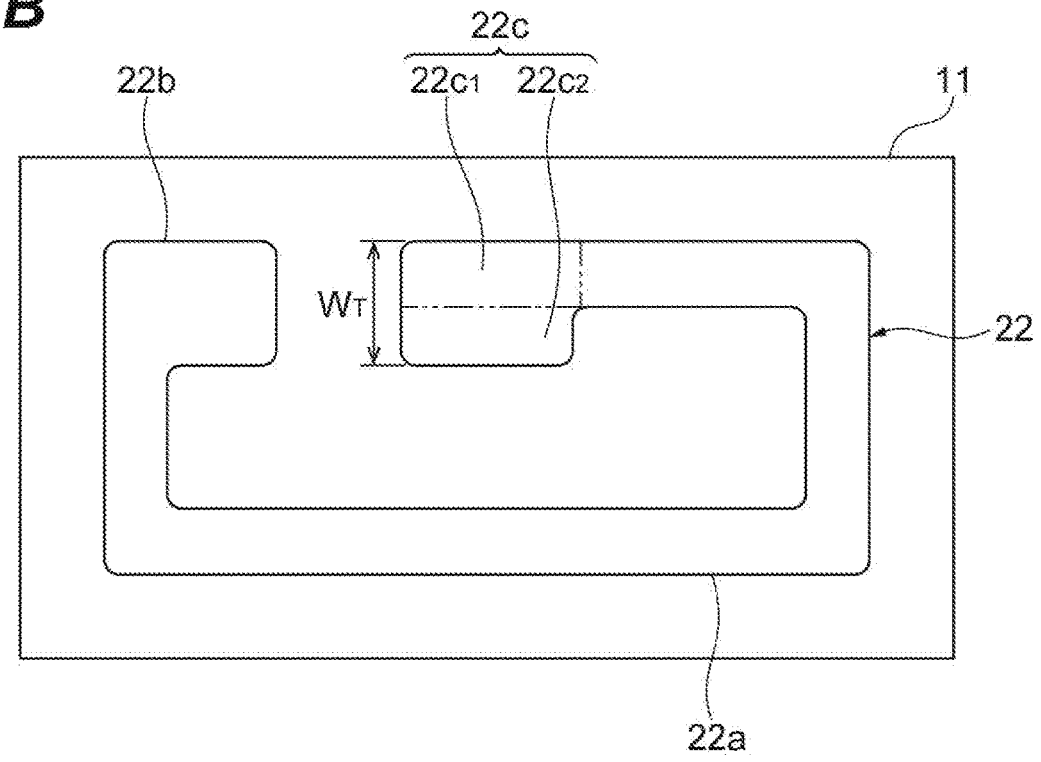
Figure 8A:
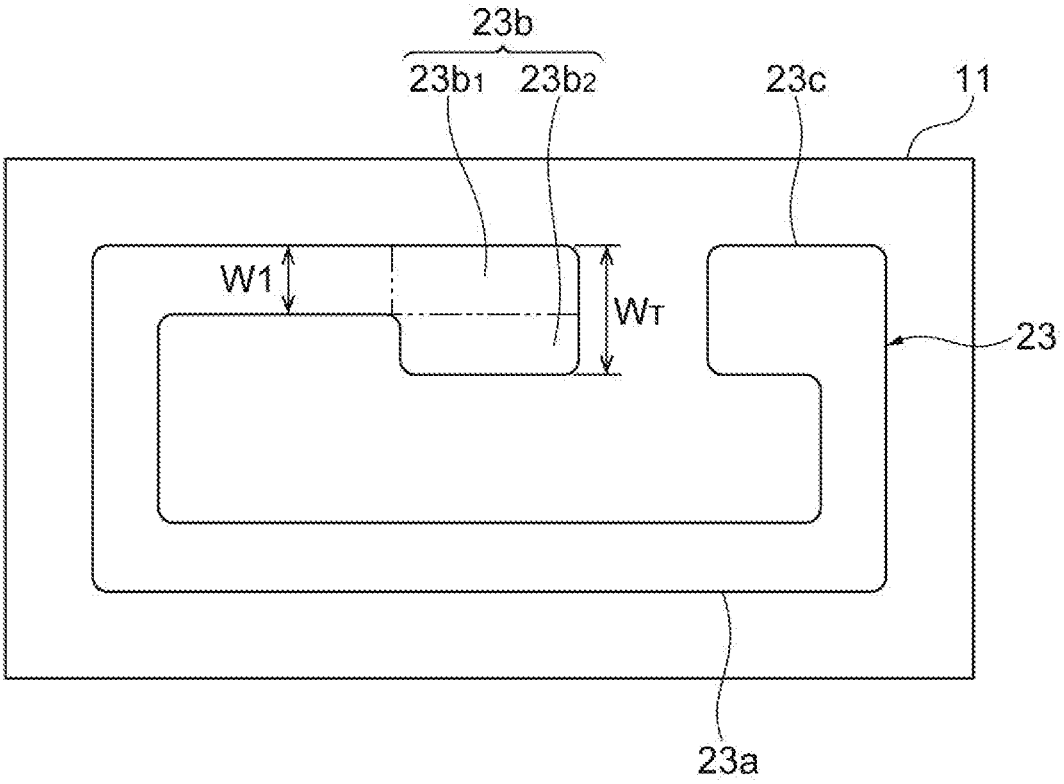
FIGS. 8A and 8B are plan views of coil conductors.
Figure 8B:
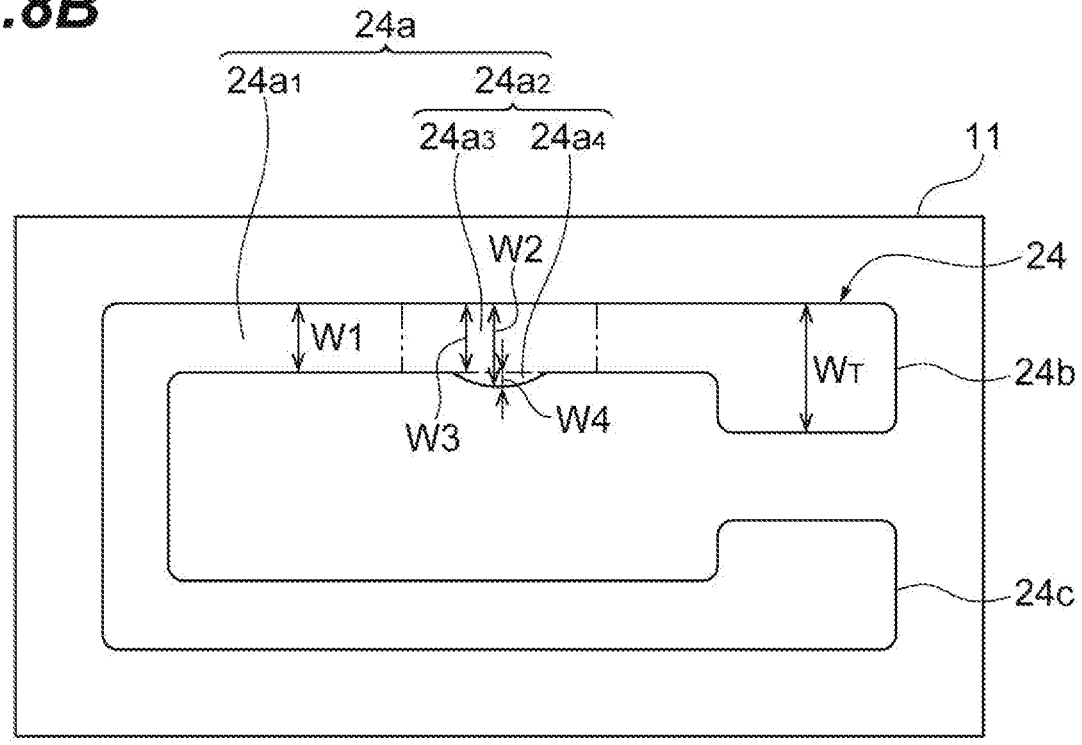

As illustrated in FIGS. 7A and 8A, each of extended width portions 21$a_4$ and 24$a_4$ of the overlapping portions 21$a_2$ and 24$a_2$ has a shape surrounded by a curve line and a straight line. The outer edges of the extended width portions 21$a_4$ and 24$a_4$ have an approximately arc shape. The maximum lengths of the extended width portions 21$a_4$ and 24$a_4$ is smaller than the lengths of predetermined width portions 21$a_3$ and 24$a_3$.

In the multilayer coil component 1A, the area of the region where the coil conductor 21 and coil conductor 22 adjacent to each other in the lamination direction overlap each other is large, as compared with in the configuration in which only the predetermined width portion 21$a_3$ overlaps the pad portion 22*c*. In the multilayer coil component 1A, the area of the region where the coil conductor 23 and coil conductor 24 adjacent to each other in the lamination direction overlap each other is large, as compared with in the configuration in which only the predetermined width portion 24$a_3$ overlaps the pad portion 23*b*. Therefore, the multilayer coil component 1A suppresses laminate deviation similarly to the multilayer coil component 1.

Third Embodiment

Next, a configuration of a multilayer coil component 1B according to a third embodiment will be described with reference to FIGS. 9, 10A, 10B, 11A, and 11B. Hereinafter, differences between the multilayer coil component 1 and the multilayer coil component 1B will be mainly described.

Figure 9:
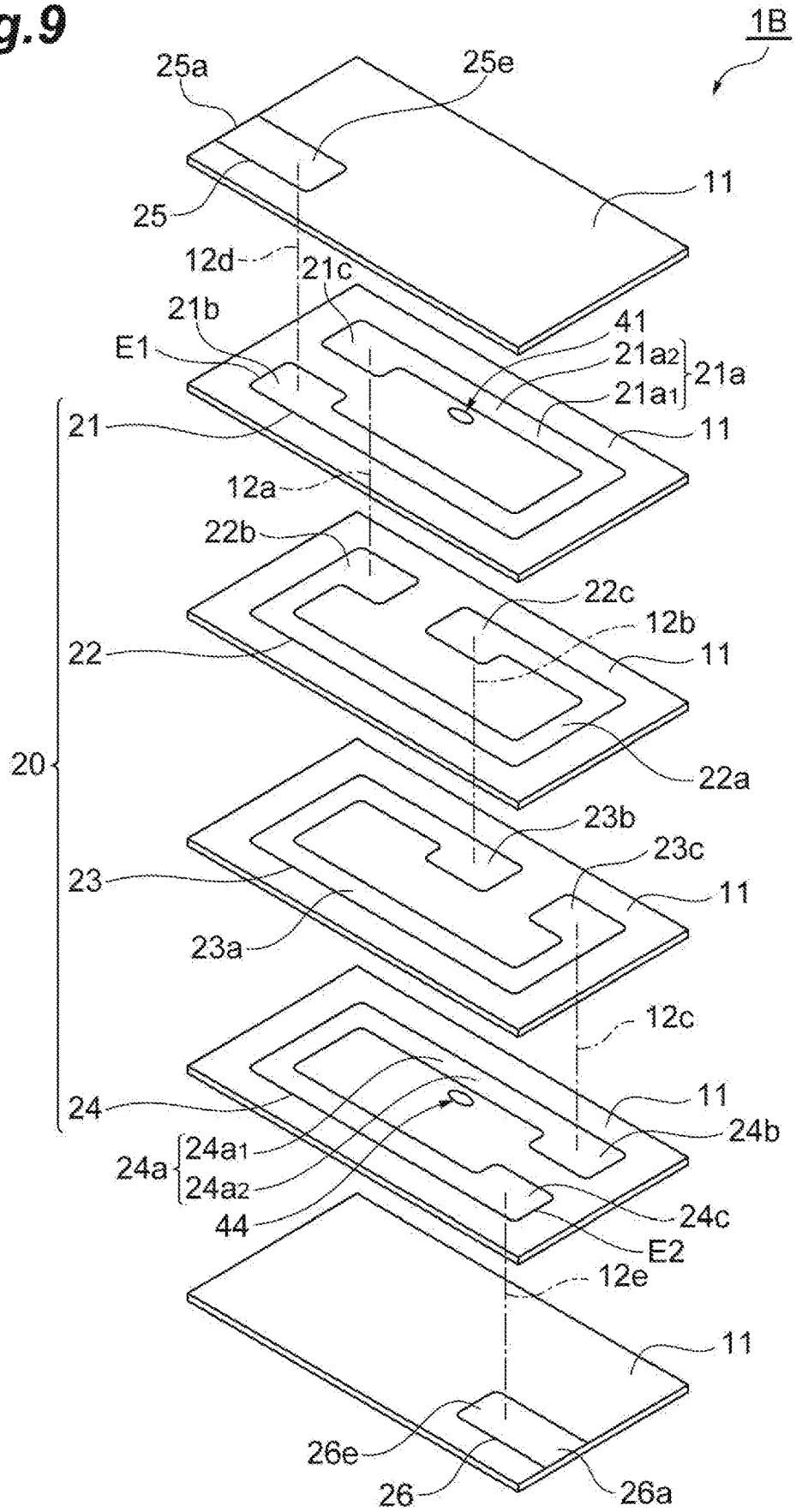
FIG. 9 is an exploded perspective view of a multilayer coil component according to a third embodiment.
Figure 10A:
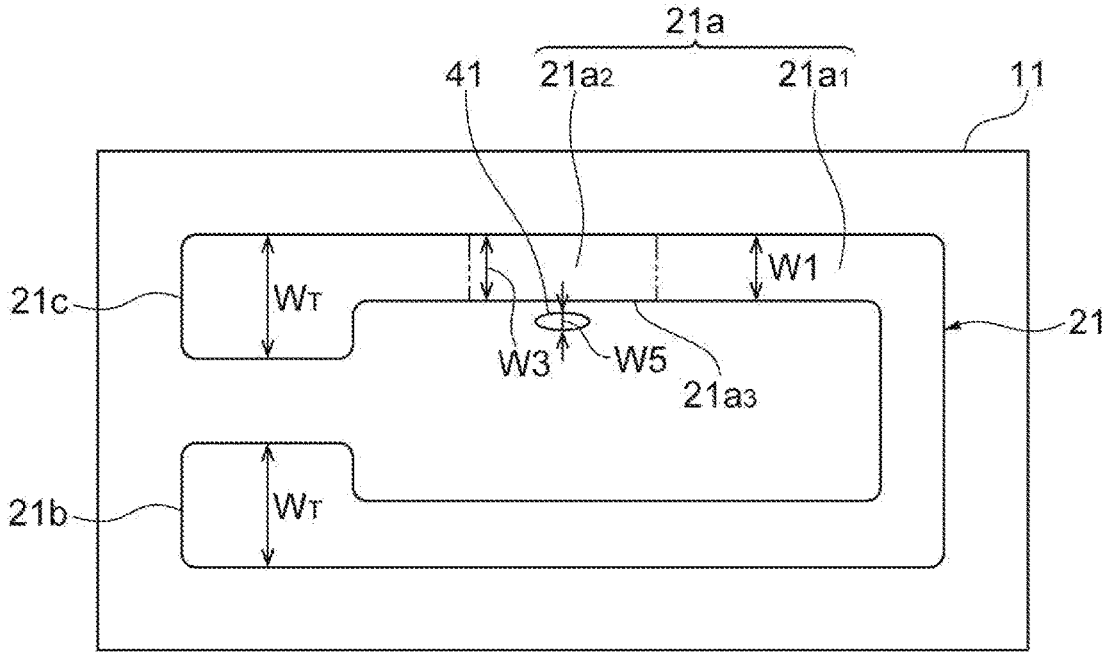
FIGS. 10A and 10B are plan views of coil conductors.
Figure 10B:
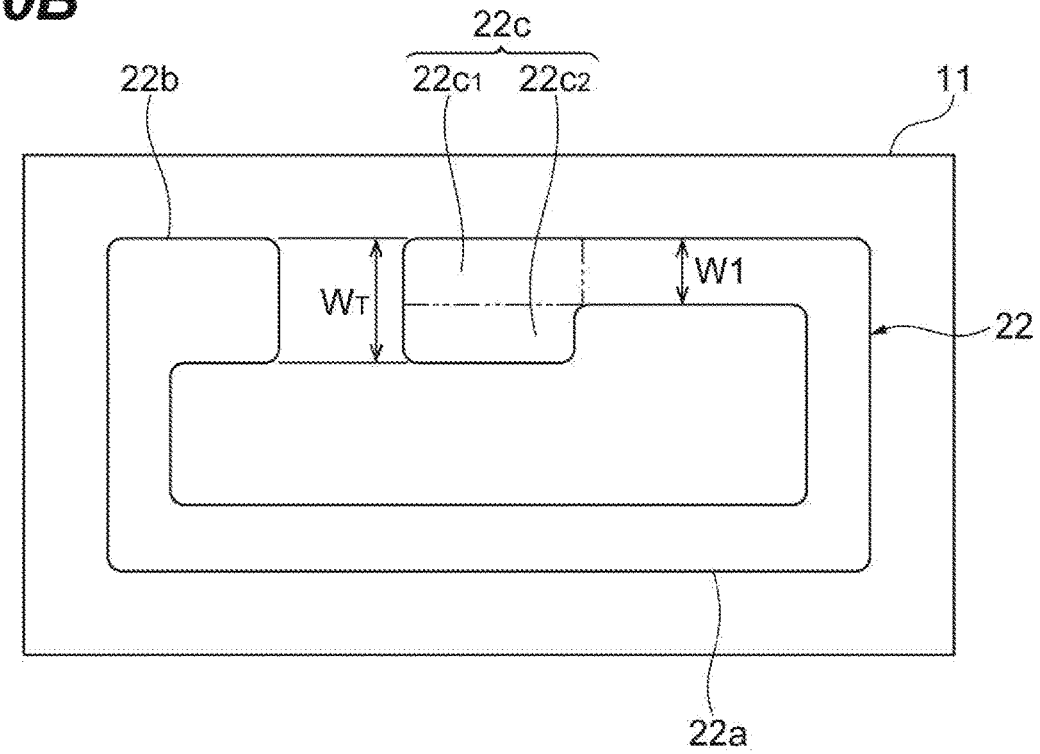
Figure 11A:
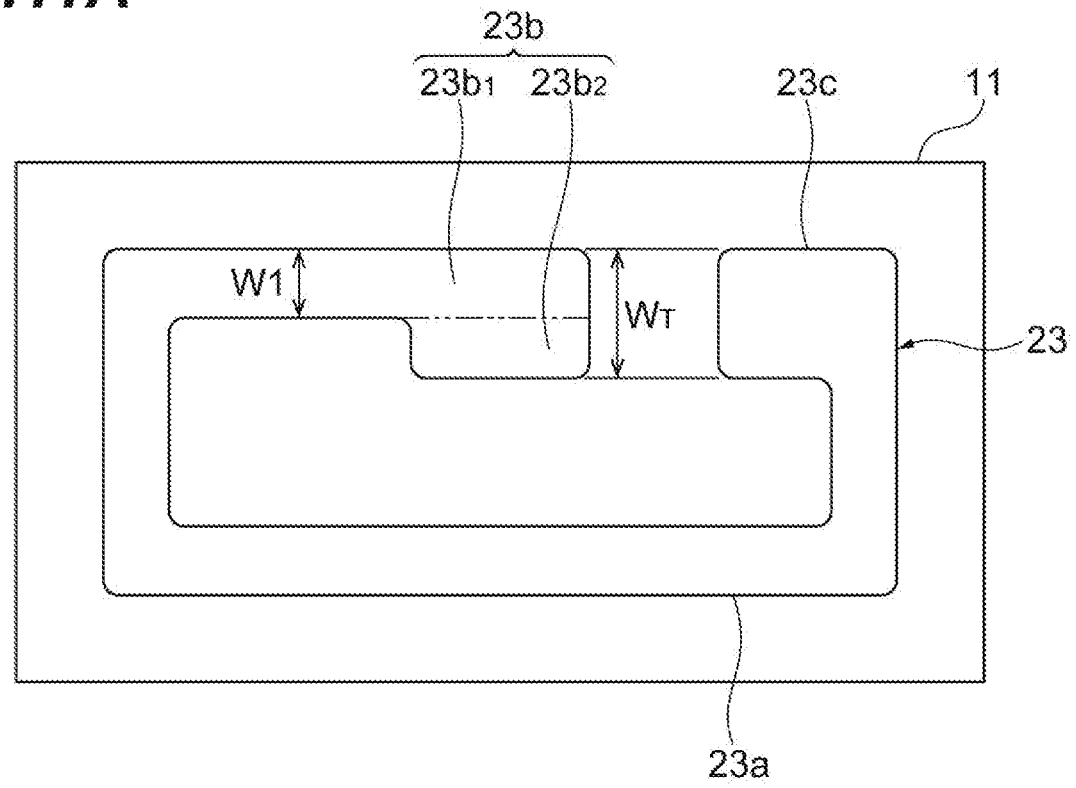
FIGS. 11A and 11B are plan views of coil conductors.
Figure 11B:
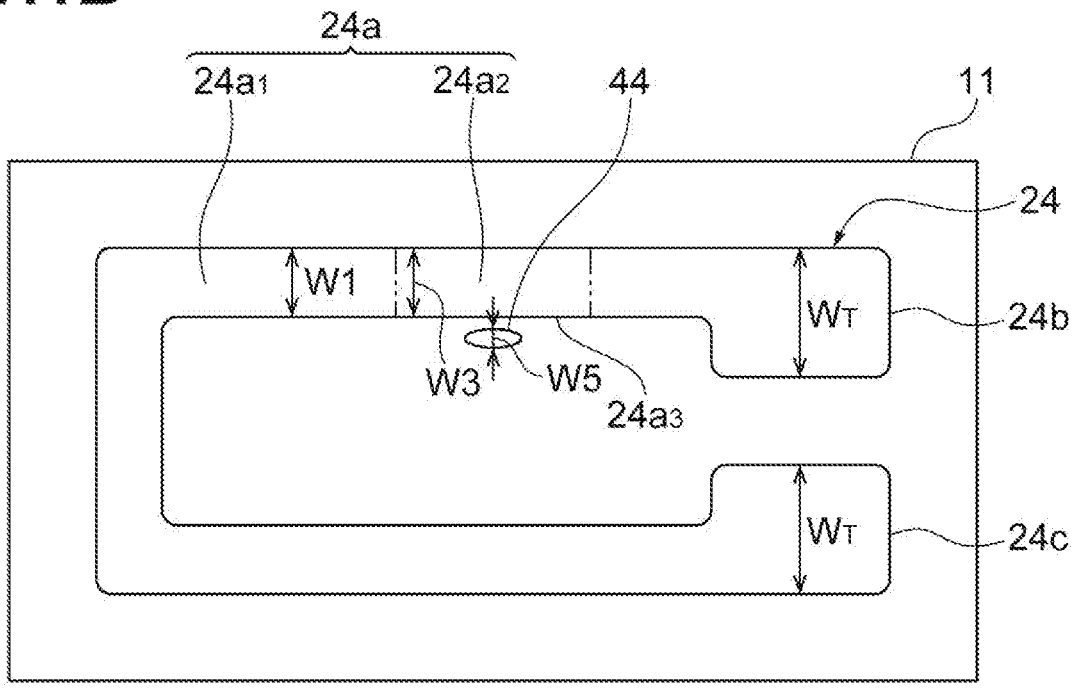

FIG. 9 is an exploded perspective view of the multilayer coil component according to the third embodiment. FIGS. 10A, 10B, 11A, and 11B are plan views of coil conductors. Similarly to the multilayer coil component 1, the multilayer coil component 1B includes the element body 2, the pair of external electrodes 4 and 5 (not illustrated), the plurality of coil conductors 21 to 24, and the plurality of lead conductors 25 and 26. In the multilayer coil component 1B, the coil portions 21*a* and 24*a* are different in shape from those in the multilayer coil component 1. In the multilayer coil component 1B, overlapping portions 21$a_2$ and 24$a_2$ include predetermined width portions 21$a_3$ and 24$a_3$ but do not include extended width portions 21$a_4$ and 24$a_4$. The multilayer coil component 1B includes a plurality of conductors 41 and 44 instead of the extended width portions 21$a_4$ and 24$a_4$. The conductor 41 is separated from the coil conductor 21. The conductor 44 is separated from the coil conductor 24. The conductors 41 and 44 constitute second internal conductors, for example.

The conductor 41 is disposed on the same layer as the coil conductor 21. The conductor 41 is adjacent to the coil conductor 22 in the lamination direction similarly to the coil conductor 21. The conductor 41 is not formed integrally with the coil conductor 21 but is formed separately from the coil conductor 21. When viewed from the lamination direction, the conductor 41 opposes the predetermined width portion 21$a_3$ with a predetermined space therebetween. The conductor 41 is positioned inside the predetermined width portion 21$a_3$. The conductor 44 is disposed on the same layer as the coil conductor 24. The conductor 44 is adjacent to the coil conductor 23 in the lamination direction similarly to the coil conductor 24. The conductor 44 is not formed integrally with the coil conductor 24 but is formed separately from the coil conductor 24. When viewed from the lamination direction, the conductor 44 opposes the predetermined width portion 24$a_3$ with a predetermined space therebetween. The conductor 44 is positioned inside the predetermined width portion 24$a_3$.

When viewed from the lamination direction, the conductors 41 and 44 have an approximately circular shape. In the present embodiment, the conductors 41 and 44 have an approximately oval shape. The short axes of the conductors 41 and 44 align with the width direction, and the long axes of the conductors 41 and 44 align with the length direction. The lengths of the conductors 41 and 44 along the long axes (that is, the maximum lengths of the conductors 41 and 44) are shorter than the lengths of the predetermined width portions 21$a_3$ and 24$a_3$. When viewed from the lamination direction, the entire conductor 41 overlaps the pad portion 22*c* adjacent in the lamination direction. When viewed from the lamination direction, the entire conductor 44 overlaps the pad portion 23*b* adjacent in the lamination direction. The sum of a width W3 of the predetermined width portion 21$a_3$ and a width W5 of the conductor 41 is larger than the width W1 of the non-overlapping portion 21$a_1$. The sum of a width W3 of the predetermined width portion 24$a_3$ and a width W5 of the conductor 44 is larger than the width W1 of the non-overlapping portion 24$a_1$. The sum of the width W3 of the predetermined width portion 21$a_3$ and the width W5 of the conductor 41 is smaller than the width $W_T$ of the pad portion 22*c* adjacent in the lamination direction. The sum of the width W3 of the predetermined width portion 24$a_3$ and the width W5 of the conductor 44 is smaller than the width $W_T$ of the pad portion 23*b* adjacent in the lamination direction.

In the multilayer coil component 1B, in addition to the predetermined width portion 21$a_3$, the conductor 41 overlaps the pad portion 22*c* adjacent in the lamination direction. In the multilayer coil component 1B, the area of the region where the coil conductor 21 and conductor 41 and the coil conductor 22 adjacent to each other in the lamination direction overlap each other is large, as compared with in the configuration in which only the predetermined width portion 21$a_3$ overlaps the pad portion 22*c*. In addition to the predetermined width portion 24$a_3$, the conductor 44 overlaps the pad portion 23*b* adjacent to each other in the lamination direction. In the multilayer coil component 1B, the area of the region where the coil conductor 24 and conductor 44 and the coil conductor 23 adjacent to each other in the lamination direction overlap each other is large, as compared with in the configuration in which only the predetermined width portion 24$a_3$ overlaps the pad portion 23*c*. Therefore, the multilayer coil component 1B suppresses laminate deviation similarly to the multilayer coil components 1 and 1A.

In the multilayer coil component 1B, the entire conductor 41 overlaps the portion 22$c_2$ of the pad portion 22*c* adjacent in the lamination direction. The entire conductor 44 overlaps the portion 23$b_2$ of the pad portion 23*b* adjacent in the lamination direction. In this case, the conductors 41 and 44 tend not to inhibit magnetic flux passing through the inside of the coil portions 21*a* and 24*a*, and thus the area of the region inside the coil portions 21*a* and 24*a* through which the magnetic flux passes tends not to decrease. Therefore, the multilayer coil component 1B ensures the desired L value.

Although the embodiments and modifications of the present invention have been described above, the present invention is not necessarily limited to the embodiments and modifications, and the embodiment can be variously changed without departing from the scope of the invention.

The pad portions 21*b* to 24*b* and 21*c* to 24*c* may not be provided at the ends of the coil portions 21*a* to 24*a*. For example, the pad portions 21*b* to 24*b* and 21*c* to 24*c* may be provided between the both ends of the coil portions 21*a* to 24*a*.

When viewed from the lamination direction, the pad portions 21*b* to 24*b* and 21*c* to 24*c* may protrude only to the outside of the corresponding coil portions 21*a* to 24*a* or may be protrude to both the outside and inside. In a case in which the pad portions 21*b* to 24*b* and 21*c* to 24*c* protrude approximately equally to the inside and outside of the corresponding coil portions 21*a* to 24*a*, laminate deviation tends not to occur.

The entire extended width portions $\mathbf{21}a_4$ and $\mathbf{24}a_4$ may not overlap the pad portions 22*c* and 23*b*. For example, only part of the extended width portions $\mathbf{21}a_4$ and $\mathbf{24}a_4$ may overlap the pad portions 22*c* and 23*b*. The entire conductors 41 and 44 may not overlap the pad portions 22*c* and 23*b*. For example, only part of the conductors 41 and 44 may overlap the pad portions 22*c* and 23*b*.

The number of the extended width portions $\mathbf{21}a_4$ and $\mathbf{24}a_4$ is not limited to two. The number of the extended width portions may be one or three or more. The number of the conductors 41 and 44 is not limited to two. The number of the conductors may be one or three or more.

What is claimed is:

1. A multilayer coil component comprising:

an element body;

a through-hole conductor;

a first layer of the element body including:

a first internal conductor including:

a first pad portion; and a first coil portion that, when viewed from a first direction, has a width smaller than a width of the first pad portion; and a second internal conductor having a width smaller than a width of the first coil portion, when viewed from the first direction;

a second layer of the element body that is separated from and adjacent to the first layer in the first direction, the second layer including:

a first internal conductor including:

a second pad portion connected to the first pad portion via the through-hole conductor and overlapping the first pad portion, when viewed from the first direction;

a third pad portion overlapping the second internal conductor and a part of the first coil portion, when viewed from the first direction; and a second coil portion that, when viewed from the first direction, has a width smaller than a width of the third pad portion; and a coil configured by electrically connecting, via the through-hole conductor, the first internal conductor of the first layer and the first internal conductor of the second layer, wherein the second layer does not have a second internal conductor.

2. The multilayer coil component according to claim 1, wherein the second internal conductor is formed integrally with the part of the first coil portion overlapping the third pad portion, and the integrally formed second internal conductor and part of the first coil portion are wider than another portion of the first coil portion.

3. The multilayer coil component according to claim 1, wherein the second internal conductor is separated from the first coil portion.

4. The multilayer coil component according to claim 1, wherein when viewed from the first direction, a sum of the width of the second internal conductor and a width of the part of the first coil portion overlapping the third pad portion is smaller than a width of the third pad portion.

5. The multilayer coil component according to claim 1, wherein when viewed from the first direction, the second internal conductor is positioned inside a loop formed by the first coil portion, and an entirety of the second internal conductor overlaps the third pad portion.

6. A method for producing the multilayer coil component according to claim 1, the method comprising:

providing a conductor pattern on a plurality of green sheets; and laminating the plurality of green sheets, wherein the conductor pattern includes a first internal conductor pattern to be the first internal conductors and a second internal conductor pattern to be the second internal conductor, the first internal conductor pattern includes a coil conductor pattern to be the coil portions and a pad conductor pattern to be the pad portions, in the providing step, the second internal conductor pattern is formed on the first layer, and in the laminating step, the green sheets are laminated such that, when viewed from a lamination direction, the second internal conductor pattern overlaps a portion of the pad conductor pattern.

7. The method for producing the multilayer coil component according to claim 6, wherein after the providing step and before the laminating step, a ratio of a thickness of the conductor pattern to a thickness of the green sheet is 1.1 to 2.0 inclusive.

8. The method for producing the multilayer coil component according to claim 6, wherein after the providing step and before the laminating step, a ratio of a width of the first portion conductor pattern to a width of the pad conductor pattern is 0.35 to 0.6 inclusive.

* * * * *